US009222328B2

(12) United States Patent
Stokes et al.

(10) Patent No.: US 9,222,328 B2
(45) Date of Patent: Dec. 29, 2015

(54) WELLHEAD LATCH AND REMOVAL SYSTEMS

(71) Applicant: Smith International, Inc., Houston, TX (US)

(72) Inventors: David A. Stokes, The Woodlands, TX (US); James R. Ford, Aberdeen (GB); Stephen Hekelaar, Spring, TX (US); Michael T. Wardley, Aberdeen (GB)

(73) Assignee: SMITH INTERNATIONAL, INC., Houston, TX (US)

( * ) Notice: Subject to any disclaimer, the term of this patent is extended or adjusted under 35 U.S.C. 154(b) by 63 days.

(21) Appl. No.: 14/098,096

(22) Filed: Dec. 5, 2013

(65) Prior Publication Data

US 2014/0158367 A1 Jun. 12, 2014

Related U.S. Application Data

(60) Provisional application No. 61/734,738, filed on Dec. 7, 2012.

(51) Int. Cl.

| | |
|---|---|
| ***E21B 7/12*** | (2006.01) |
| ***E21B 33/068*** | (2006.01) |
| ***E21B 23/00*** | (2006.01) |

(Continued)

(52) U.S. Cl.

CPC ..... *E21B 33/068* (2013.01); *E21B 23/006* (2013.01); *E21B 29/005* (2013.01); *E21B 33/038* (2013.01)

(58) Field of Classification Search

CPC ..... E21B 29/12; E21B 33/038
USPC ..... 166/338, 361, 368, 298
See application file for complete search history.

(56) References Cited

U.S. PATENT DOCUMENTS 3,019,840 A * 2/1962 Kennard ..... 294/86.24
4,047,568 A 9/1977 Aulenbacher (Continued)

FOREIGN PATENT DOCUMENTS

WO WO2009028953 A1 3/2009

OTHER PUBLICATIONS

Jerry Fisher, Tom Bailey, R.K. Bansal, and Mohammed A. HAQ, "Drilling, Production, Intervention Milling Tool—Records Achieved in Milling of Cemented Tubulars, a Technological Standout with Real Field Results", SPE Eastern Regional Meeting, Columbus, Ohio, Aug. 17-19, 2011 (6 pages).

(Continued)

*Primary Examiner* — Matthew Buck
*Assistant Examiner* — Aaron Lembo

(57) ABSTRACT

A wellhead latch assembly may include one or more latches for attaching to a wellhead and allowing removal of the wellhead during a well abandonment process. The wellhead latch assembly may include an inner core coupled to the latches, and an outer sleeve for selectively latching and unlatching the latches to the wellhead. The inner core may abut the wellhead and can include a groove having circumferential and/or longitudinal features. The outer sleeve may include a pin which travels within the groove and a set of cut-outs for alignment with the latches. When the cut-outs align with the latches, the latches may expand radially outward and disengage the wellhead. As the outer sleeve moves axially or rotationally relative to the inner core, the latches may fall out of alignment with the cut-outs and move radially inwardly to engage or capture the wellhead.

20 Claims, 13 Drawing Sheets

(51) Int. Cl.
*E21B 29/00* (2006.01)
*E21B 33/038* (2006.01)

(56) References Cited

U.S. PATENT DOCUMENTS

| | | | | |
|---|---|---|---|---|
| 4,550,781 | A * | 11/1985 | Kagler, Jr. | 166/340 |
| 4,703,802 | A | 11/1987 | Bryan et al. | |
| 4,943,188 | A * | 7/1990 | Peppel | 405/223.1 |
| 5,146,989 | A | 9/1992 | Rouse | |
| 5,318,115 | A | 6/1994 | Rouse | |
| 5,743,331 | A | 4/1998 | Adkins et al. | |
| 5,791,418 | A | 8/1998 | Milberger et al. | |
| 5,947,642 | A | 9/1999 | Teixeira et al. | |
| 6,029,745 | A | 2/2000 | Broussard et al. | |
| 6,056,049 | A * | 5/2000 | Davis | 166/55.7 |
| 6,330,919 | B1 | 12/2001 | McGarian | |
| 6,357,528 | B1 | 3/2002 | Davis et al. | |
| 6,629,565 | B2 | 10/2003 | Harrell | |
| 7,090,019 | B2 * | 8/2006 | Barrow et al. | 166/361 |
| 7,757,754 | B2 * | 7/2010 | McKay | 166/55.7 |
| 7,997,336 | B2 | 8/2011 | Sokol et al. | |
| 8,056,633 | B2 * | 11/2011 | Barra et al. | 166/298 |
| 8,057,121 | B2 * | 11/2011 | Gallagher | 403/318 |
| 8,307,903 | B2 * | 11/2012 | Redlinger et al. | 166/341 |
| 8,662,182 | B2 * | 3/2014 | Redlinger et al. | 166/338 |
| 8,757,269 | B2 * | 6/2014 | Tabor et al. | 166/340 |
| 8,919,447 | B2 * | 12/2014 | Thuet et al. | 166/338 |
| 2002/0023755 | A1 | 2/2002 | McGarian | |
| 2006/0199433 | A1 * | 9/2006 | Riggs et al. | 439/607 |
| 2010/0163244 | A1 | 7/2010 | Desai et al. | |
| 2010/0326665 | A1 | 12/2010 | Redlinger et al. | |
| 2011/0225789 | A1 | 9/2011 | Darnell | |
| 2014/0158367 | A1 * | 6/2014 | Stokes et al. | 166/368 |

OTHER PUBLICATIONS

Odd-Inge Sorheim, Bjorn Thore Ribesen, Trond Eggen Sivertsen, Arild Saasen, and Oystein Kanestrom, "Abandonment of Offshore Exploration Wells using a Vessel Deployed System for Cutting and Retrieval of Wellheads", SPE Arctic and Extreme Environments Conference & Exhibition, Moscow, Russia, Oct. 18-20, 2011 (6 pages).

Jim Basuki Surgaatmadja, Andrew John Bailey, and Silverio A. Sierra, "HydraJet Testing Under Deep Well Conditions Defines New Requirements for Hard-Rock Perforating", 2009 SPE Rocky Mountain Petroleum Technology Conference, Denver, Colorado, USA, Apr. 14-16, 2009 (12 pages).

Galen Roy Hebert, Mark Joseph Sackash, and Richard Hogan, "Cutting Concentric Casing Strings With Sand Slurry", 2008 SPE/ICoTA Coiled Tubing and Well Intervention Conference and Exhibition, The Woodlands, Texas, USA, Apr. 1-2, 2008 (6 pages).

Jim Basuki Surjaatmadja, Jeff Bezanson, Sharlene Dawn Lindsay, Peter Antonio Ventosilla, and Keith Alan Rispler, "New Hydra-Jet Tool Demonstrates Improved Life for Perforating and Fracturing Applications", 2008 SPE/ICoTA Coiled Tubing and Well Intervention Conference and Exhibition, The Woodlands, Texas, USA, Apr. 1-2, 2008 (15 pages).

Charles Odita, Adedokun Adenipekun, Miebaka Wakama, Dondo Ahire, and James Oho, "Abandonment of Wells in Shell Nigeria Operations", SPE International Technical Conference and Exhibition, Abuja, Nigeria, Aug. 2-4, 2004 (6 pages).

Edwin B. Norwood, Njoku Chinoyerem, and Victor Ranyis, "Subsea Abandonment from Semi With Surface BOP", SPE/IADC Drilling Conference, Amsterdam, Netherlands, Feb. 19-21, 2003 (15 page).

B. Morrice, E. McGennis, and S.J.N. Kirby, "The Subsea Well Decommissioning Project", 1997 Offshore Europe Conference, Aberdeen, United Kingdom, Sep. 9-12, 1997 (7 pages).

P.D. Brindley and M. Corcoran, "Offshore Abandonment Activities: The Energy and Environmental Impacts", Offshore Europe Conference, Aberdeen, Scotland, Sep. 5-8, 1995 (15 pages).

D.L. Morrill, "Abandonment of a Subsea Well", Journal of Petroleum Technology, vol. 30, Issue 3, Mar. 1978, pp. 435-439.

David Buchmiller, Ole Rengard, Lars Tore Haug, Torfinn Horte, Guttorm Grytoyr, and Erling Katla, "Advancements in Structural Well Integrity Design and Operation", Offshore Technology Conference, Houston, Texas, USA, Apr. 30-May 3, 2012 (14 pages).

R.S. Matkowski, J.A. Carter, and S.C. Townsend, "A Multiple Well Abandonment Program: Methodology and Techniques", Offshore Technology Conference, Houston, Texas, May 2-5, 1994 (12 pages).

A.T. Duguid and R.A. McBeth, "Drake F-76 In-Situ Abandonment of a High Arctic Offshore Completion and Facilities", Journal of Canadian Petroleum Technology, vol. 39, Issue 5, May 2000, pp. 33-40.

Richard Segura, Mohammed A. HAQ, and Steve Durrant, "How Advances in Technology Can Help Safely Abandon Offshore Exploratory Wells in and Around the Caribbean Sea Region", SPETT 2012 Energy Conference and Exhibition, Port of Spain, Trinidad, Jun. 11-13, 2012 (6 pages).

Richard Segura and Mohammed A. HAQ, "How Advances in Technology can Help Safely Abandon Off-Shore Subsea Wells", SPE Saudi Arabia Section Technical Symposium and Exhibition, Al-Khobar, Saudia Arabia, Apr. 8-11, 2012 (8 pages).

Stephen Hekelaar, Kenneth Gibson, and Praful Desai, "Increasing Reliability of Cutting/Pulling Casing in a Single Trip", SPE Offshore Europe Oil and Gas Conference and Exhibition, Aberdeen, UK, Sep. 6-8, 2011.

* cited by examiner

WELLHEAD LATCH AND REMOVAL SYSTEMS

CROSS-REFERENCE TO RELATED APPLICATIONS

This application claims the benefit of, and priority to, U.S. Patent Application Ser. No. 61/734,738, filed on Dec. 7, 2012, and entitled "WELLHEAD LATCH AND REMOVAL SYSTEMS," which application is incorporated herein by this reference in its entirety.

BACKGROUND

When an oil or gas well is formed, a borehole is drilled into the subterranean formation and extended to the location of an oil or gas deposit. At the surface of the borehole, a wellhead may be used. The wellhead may provide pressure containment capabilities for controlling pressure developed within the borehole. The wellhead may also provide a physical, structural interface for drilling and production equipment operating within the borehole.

A well may be abandoned when the oil or gas reserves of a well are depleted, or when the production costs exceed the expected returns. At that time the well may be plugged in accordance with environmental and regulatory requirements. For instance, a cement material may be flowed into a well for formation of a cement plug. After testing the structural integrity of the cement material, the wellhead may also be removed. Various techniques may be used to remove the wellhead. On land, for instance, a cutter may be placed within the wellhead and used to cut the casing below the ground surface. Once the casing is cut, the wellhead can be lifted and removed. The wellhead may then be reused at another well site.

Removal of a wellhead for a subsea well often uses a different process. For instance, following plugging of the borehole, an explosive charge may be located within the well casing below the subsea surface. Upon detonating the charge, the well casing may be cut to allow removal of the wellhead assembly. In other cases, a mechanical or hydraulic cutting apparatus may be lowered from the surface towards the wellhead. Underwater divers or a remotely operated vehicle may be used to locate the cutter in the borehole or to secure the cutting apparatus to the wellhead. Once the cutting process is completed, the cutting apparatus can be disconnected and removed. A wellhead removal device may then be lowered and connected to the wellhead to allow the wellhead to be lifted from the subsea location.

SUMMARY OF THE DISCLOSURE

A latch assembly may include an inner core and an outer sleeve enclosing at least a portion of the inner core. At least one latch coupled to the inner core may be selectively moved between a released position and a latched position. In the released position, the latches may align with respective cut-outs in the outer sleeve. When in the latched position, the latches may be out of alignment with the cut-outs in the outer sleeve.

Some embodiments relate to a well abandonment tool which may include a rotary tool and a wellhead latch assembly coupled to the rotary tool. The wellhead latch may include a slotted inner body and an outer sleeve having one or more pins. The pins may follow a groove in the slotted inner body. Latches may be used to selectively translate radially between a latched position and a released position. In the latched position the latches may be out of alignment with cut-outs, depressions, or openings in the outer sleeve.

Embodiments are disclosed which relate to a method for removing a wellhead. A well abandonment tool may be deployed to a subsea wellhead. The well abandonment tool may include a cutting tool and a wellhead latch assembly. The wellhead latch assembly may be engaged with the subsea wellhead, and an axial force may be applied to the wellhead latch assembly using a conveyance system. The axial force may cause the wellhead latch assembly to latch to the subsea wellhead. The subsea wellhead may be separated from borehole casing using the cutting tool, and the subsea wellhead may be removed using an additional axial force on the conveyance system. The additional axial force may be directionally opposite the axial force used to latch the wellhead latch assembly to the subsea wellhead.

This summary is provided solely to introduce some features and concepts that are further developed in the detailed description. Other features and aspects of the present disclosure will become apparent to those persons having ordinary skill in the art through consideration of the ensuing description, the accompanying drawings, and the appended claims. This summary is therefore not intended to identify key or essential features of the claimed subject matter, nor is it intended to be used as an aid in limiting the scope of the claims.

BRIEF DESCRIPTION OF DRAWINGS

In order to describe various features and concepts of the present disclosure, a more particular description of certain subject matter will be rendered by reference to specific embodiments which are illustrated in the appended drawings. Understanding that these drawings are drawn to scale for some illustrative embodiments, but are not to be considered to be limiting in scope, nor drawn to scale for each embodiment contemplated herein, various embodiments will be described and explained with additional specificity and detail through the use of the accompanying drawings in which.

DETAILED DESCRIPTION

Figure 1:
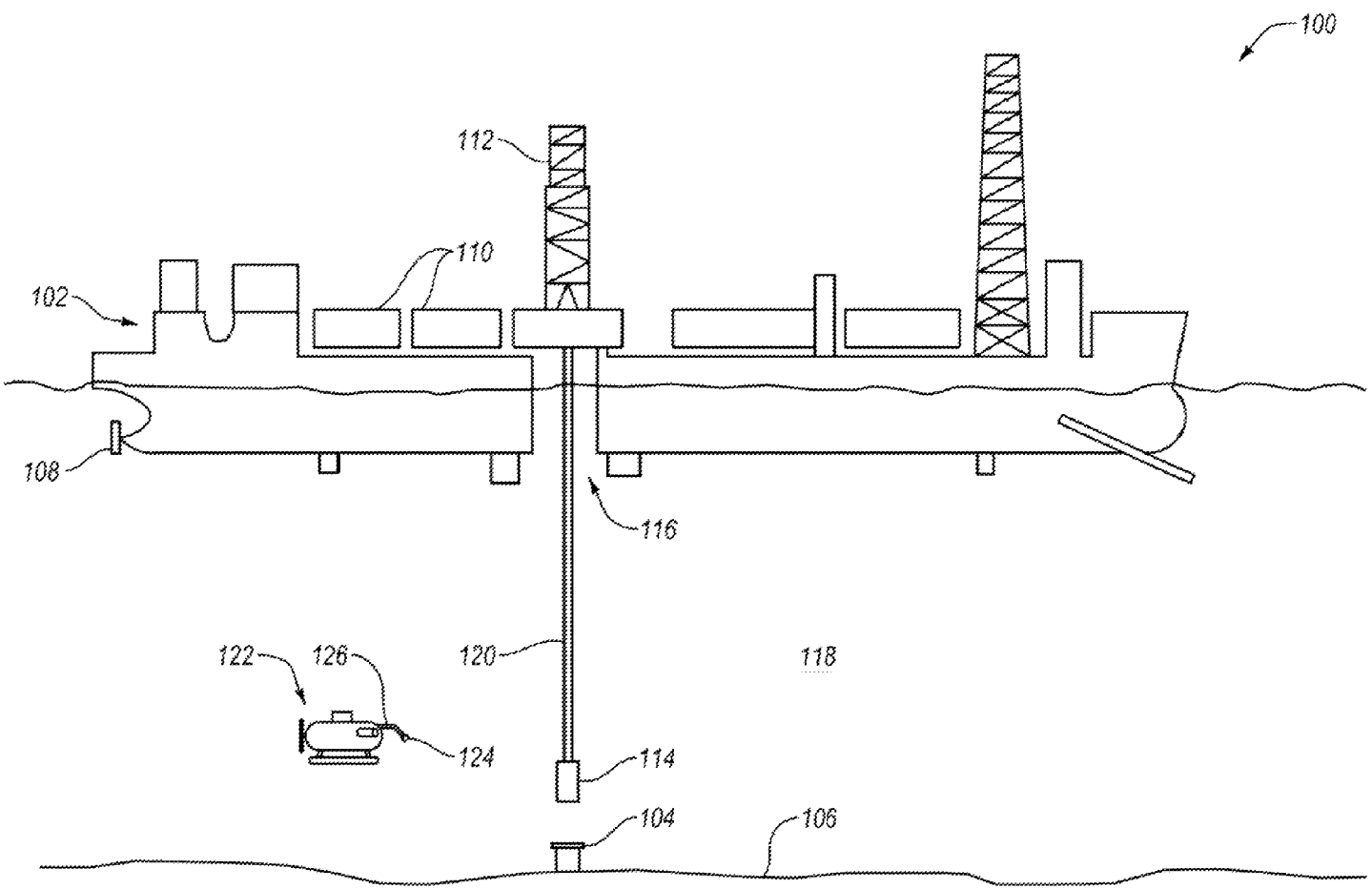
FIG. 1 schematically illustrates a well abandonment system for removing and/or retrieving a wellhead, according to some embodiments of the present disclosure.

In accordance with some aspects of the present disclosure, one or more embodiments herein relate to latch assemblies for coupling to a wellhead. More particularly, one or more embodiments disclosed herein may relate to wellhead latch assemblies used in wellhead abandonment and retrieval processes. An example wellhead latch assembly may be used in connection with a cutting tool that cuts a casing below the wellhead, and allows the cutting tool, wellhead latch assembly, and wellhead to be removed in a single trip.

Some principles and uses of the teachings of the present disclosure may be better understood with reference to the accompanying description, figures and examples. It is to be understood that the details set forth herein and in the figures are presented as examples, and are not intended to be construed as limitations to the disclosure. Furthermore, it is to be understood that the present disclosure and embodiments related thereto can be carried out or practiced in various ways and that aspects of the present disclosure can be implemented in embodiments other than the ones outlined in the description below.

To facilitate an understanding of various aspects of the embodiments of the present disclosure, reference will be made to various figures and illustrations. In referring to the figures, relational terms such as, but not exclusively including, "bottom," "below," "top," "above," "back," "front," "left," "right," "rear," "forward", "up," "down," "horizontal," "vertical," "clockwise," "counterclockwise," "inside," "outside," and the like, may be used to describe various components, including their operation and/or illustrated position relative to one or more other components. Relational terms do not indicate a particular orientation or position for each embodiment. For example, a component of a wellhead latch assembly that is "below" another component may be at a lower elevation while attached to a wellhead, but may have a different orientation during assembly or when detached from the wellhead or a wellhead abandonment system. Similarly, a component that is "inside" another component within one wellhead latch assembly may be "outside" another component in another embodiment of a wellhead latch assembly. Accordingly, relational descriptions are intended solely for convenience in facilitating reference to some embodiments described and illustrated herein, but such relational aspects may be reversed, flipped, rotated, moved in space, placed in a diagonal orientation or position, placed horizontally or vertically, or similarly modified.

Relational terms may also be used to differentiate between similar components; however, descriptions may also refer to certain components or elements using designations such as "first," "second," "third," and the like. Such language is also provided for differentiation purposes, and is not intended limit a component to a singular designation. As such, a component referenced in the specification as the "first" component may include the same component that may be referenced in the claims as a "second," "third," or other component. Furthermore, to the extent the specification or claims refer to "an additional" or "other" element, feature, aspect, component, or the like, it does not preclude there being a single element, feature, aspect, or component. The terms "a" or "an" are open-ended and are intended to be inclusive of other components and understood as "one or more" of a corresponding element, feature, benefit, component, or the like. A component, feature, structure, or characteristic described herein should not be interpreted as being required or essential unless explicitly described as such for all embodiments.

Meanings of technical and scientific terms used herein are to be understood as by a person having ordinary skill in the art to which embodiments of the present disclosure belong, unless otherwise defined. Embodiments of the present disclosure can be implemented in the testing or practice with methods and materials equivalent or similar to those described herein.

Referring now to FIG. 1, a well abandonment system 100 is shown according to some embodiments of the present disclosure. In the illustrated embodiment, the well abandonment system 100 includes a surface vessel 102 positioned generally over a wellhead 104 located on or near a sea floor 106. To position the surface vessel 102 at a desired location relative to the wellhead 104, the surface vessel 102 may include a propulsion system 108. Example propulsion systems 108 may include components such as a thrusters or propellers, or other components which can move and/or maintain the surface vessel 102 at a desired position.

The surface vessel 102 may include any number of different components or systems. For instance, in one embodiment, the surface vessel 102 may be a drilling supply vessel suitable for performing multiple drilling-related functions. Example functions that may be performed by such a drilling supply vessel include, but are not limited to, production, storage or offloading capabilities. Accordingly, in some embodiments, the supply vessel 102 may include storage 110. The storage 110 may be used to store materials used in a drilling operation and/or product (e.g., oil or gas) produced from a well.

In at least some embodiments of the present disclosure, the surface vessel 102 may be used to pull, lift, or carry loads. In FIG. 1, for instance, the vessel 102 may include a lift system 112. In general, the lift system 112 may be used to lift and carry loads extended downward from the surface vessel 102. In the same or other embodiments, however, the lift system 112 may be used to apply a force to push tools, equipment, or other components downward. Thus, the lift system 112 may be used to apply an upwardly or downwardly directed axial force.

In accordance with at least some embodiments, the lift system 112 may be used to deploy a tool 114 from the surface vessel 102 to the wellhead 104, and to return the tool 114 to the surface vessel 102. In such an embodiment, the surface vessel 102 may include a moonpool 116 or other similar structure. The moonpool 116 may provide access to the sea 118. In FIG. 1, for instance, the moonpool 116 may be generally aligned with the lift system 112 so that a tool 114 may be extended downward into the sea 118, optionally without extending the tool 114 over a side of the surface vessel 102. The lift system 112 may therefore raise and lower the tool 114.

The particular size, position and configuration of the moonpool 116 may be varied. In accordance with one embodiment, the moonpool 116 may be sized to have sufficient width and length to accommodate tools (e.g., tool 114) that may be lowered or raised using the lift system 112. The position of the moonpool 116 may also vary. As shown in FIG. 1, the moonpool 116 may be generally aligned with the lift system 112. In other embodiments, they may be offset. Moreover, the moonpool 116 and/or lift system 112 may be generally centered within the surface vessel 102 (e.g., centered along a length and/or width of the surface vessel 102). Centering the moonpool 116 and lift system 112 may allow for added stability and/or support in lifting and carrying loads. In embodiments where the moonpool 116 is generally centered, the center may be determined using length and/or width dimensions. In other embodiments, the center may be determined by using the center of mass of the surface vessel 102.

The type of loads raised or lifted by the lift system 112, whether or not through the moonpool 116, may vary based on the particular application for which the surface vessel 102 is used. In one embodiment, for instance, the tool 114 may include a cutting tool used for cutting a borehole casing. Following cutting of the casing, the wellhead 104 can be removed using one or more latches that couple to the wellhead 104. As discussed herein, the one or more latches used in removing the wellhead 104 may be coupled to the cutting tool so that the wellhead 104 may be cut and removed in a single trip; however, other embodiments contemplate separate trips for cutting and removing the wellhead 104.

In the embodiment shown in FIG. 1, the tool 114 may be directed from the lift system 112 to the wellhead 104 using a conveyance system 120. The conveyance system 120 may generally couple the tool 114 to the lift system 112 and/or the surface vessel 102, but may also provide other functions. For instance, as discussed in greater detail herein, the conveyance system 120 may be used to provide power, hydraulic fluid, cutting fluid, or other components, or some combination thereof, to the tool 114. Conveyance system 120 may be a drill string, tubulars, or similar rigid conveyance. Conveyance system 120 may also be an umbilical line, coiled tubing, wireline, or similar flexible conveyance.

The tool 114 may be positioned and coupled to the wellhead 104 in any suitable manner. In accordance with at least some embodiments, a remotely operated vehicle ("ROV") 122 may be used. In this particular embodiment, the ROV 122 may include devices such as a camera 124, handling tool 126, or other components. The camera 124 may, for instance, allow for a video feed to be provided to an operator located on the surface vessel 102 or elsewhere, so that the operator can view the position of the ROV 122 and tool 114 relative to the wellhead 104. The handling tool 126 may be able to grasp or couple to the tool 114. Remote control of the ROV 122 may then allow the ROV 122 to move the tool 114 into alignment with the wellhead 104 and/or to couple the tool 114 to the wellhead 104.

The well abandonment system 100 as described above is merely illustrative of one example system that may be used in connection with embodiments of the present disclosure. In particular, the well abandonment system 100 may use the tool 114 (e.g. a cutting tool) to cut the casing of a borehole to free the wellhead 104. The same tool 114, or a different tool, may then be used to exert a force on the wellhead 104 to lift the wellhead 104 toward the surface vessel 102. For such use, the lift system 112 may have any desired construction, and may be a derrick, hydraulic lift, or crane in some embodiments, but may have other configurations in other embodiments. Further, the operational requirements of the lift system 112 may vary. For instance, in one embodiment the lift system 112 may be capable of exerting a compressive force directed downwardly towards the sea floor 106. In other embodiments, the lift system 112 may be used primarily to exert an upwardly directed lifting force. When providing a lift force, the lift system 112 may be able to raise or carry loads weighing up to 500,000 pounds (226,800 kg), although the weight of a load may be more or less than 500,000 pounds (226,800 kg). In some embodiments, the lift system 112 may be able to raise or carry loads up to 200,000 pounds (90,720 kg).

The well abandonment system 100 may also include other components in addition to, or instead of, those illustrated in FIG. 1. For instance, the wellhead 104 may be coupled to other components such as a blow out preventer, riser, or other component. Similarly, the surface vessel 102 may include other components, including guidance systems, fuel systems, anchoring systems, and the like. Moreover, while the surface vessel 102 may be a drilling supply vessel or other vehicle providing flexible or versatile use, in other embodiments the surface vessel 102 may be more limited or may not be a drilling supply vessel.

Figure 2:
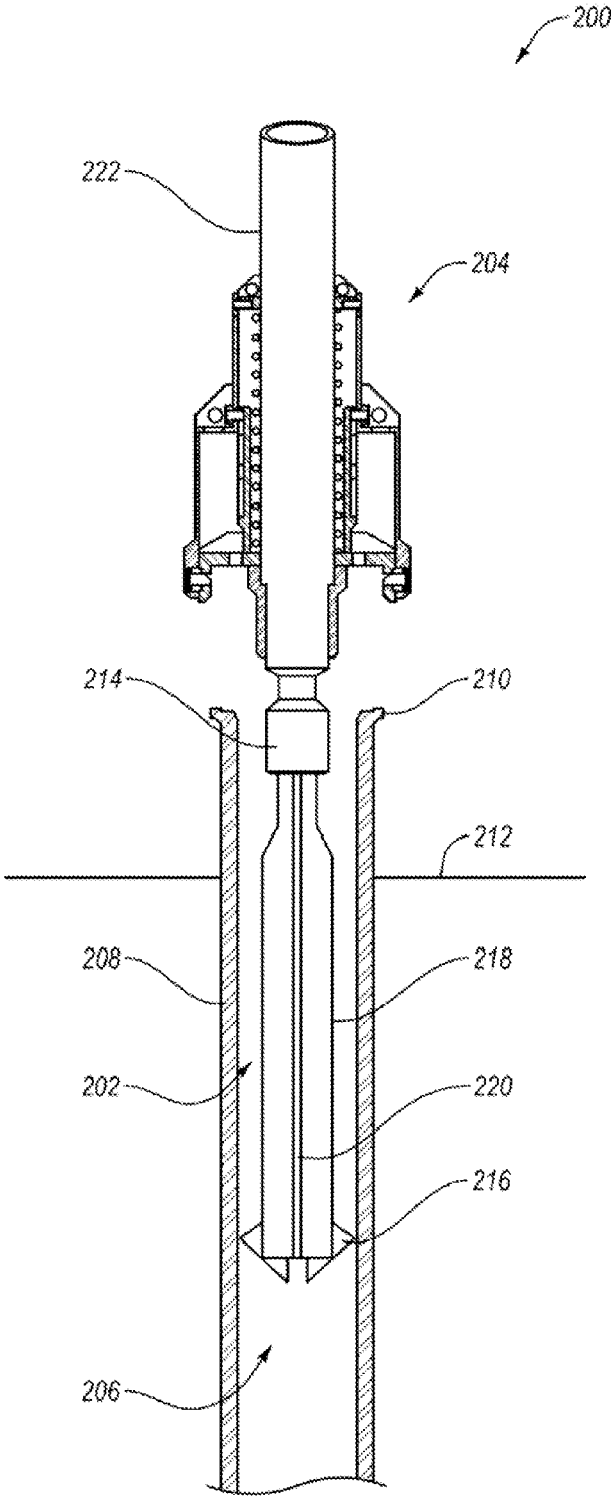
FIG. 2 illustrates a partial cross-sectional view of a cutting tool lowered into a borehole, according to some embodiments of the present disclosure.
Figure 3:
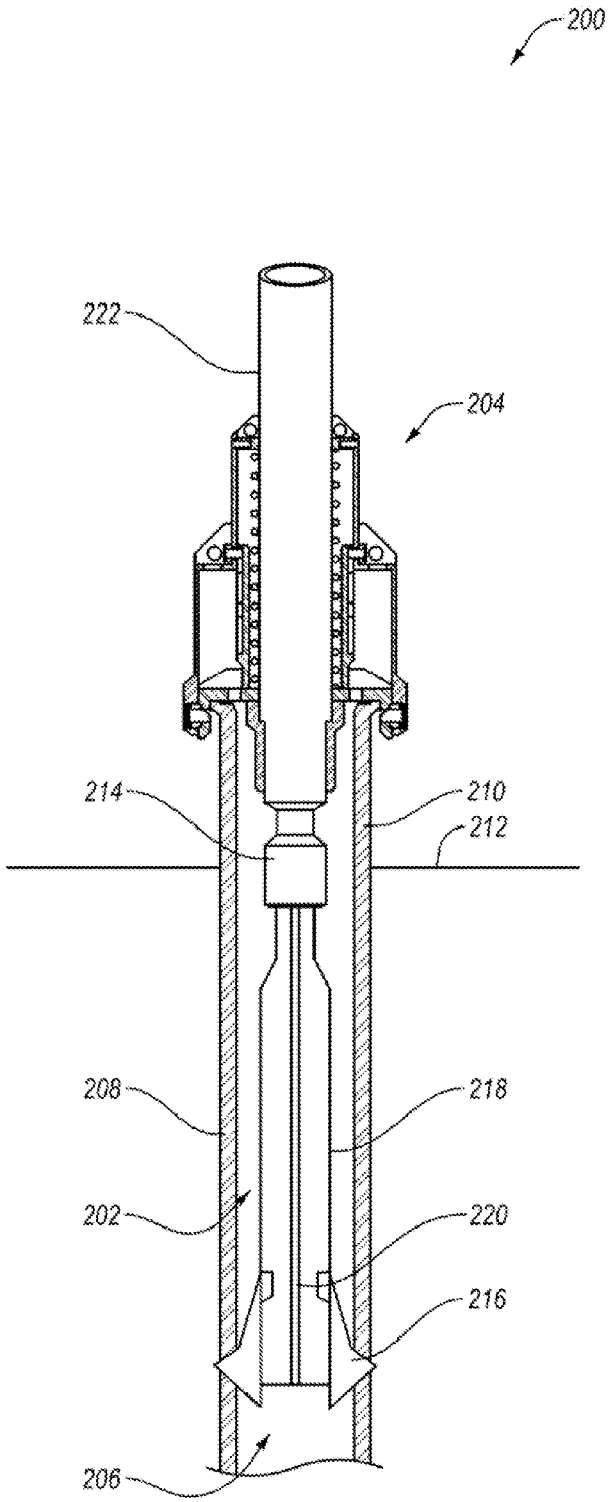
FIG. 3 illustrates a partial cross-sectional view of the cutting tool of FIG. 2 when the latch assembly engages a wellhead, in accordance with some embodiments of the present disclosure.
Figure 4:
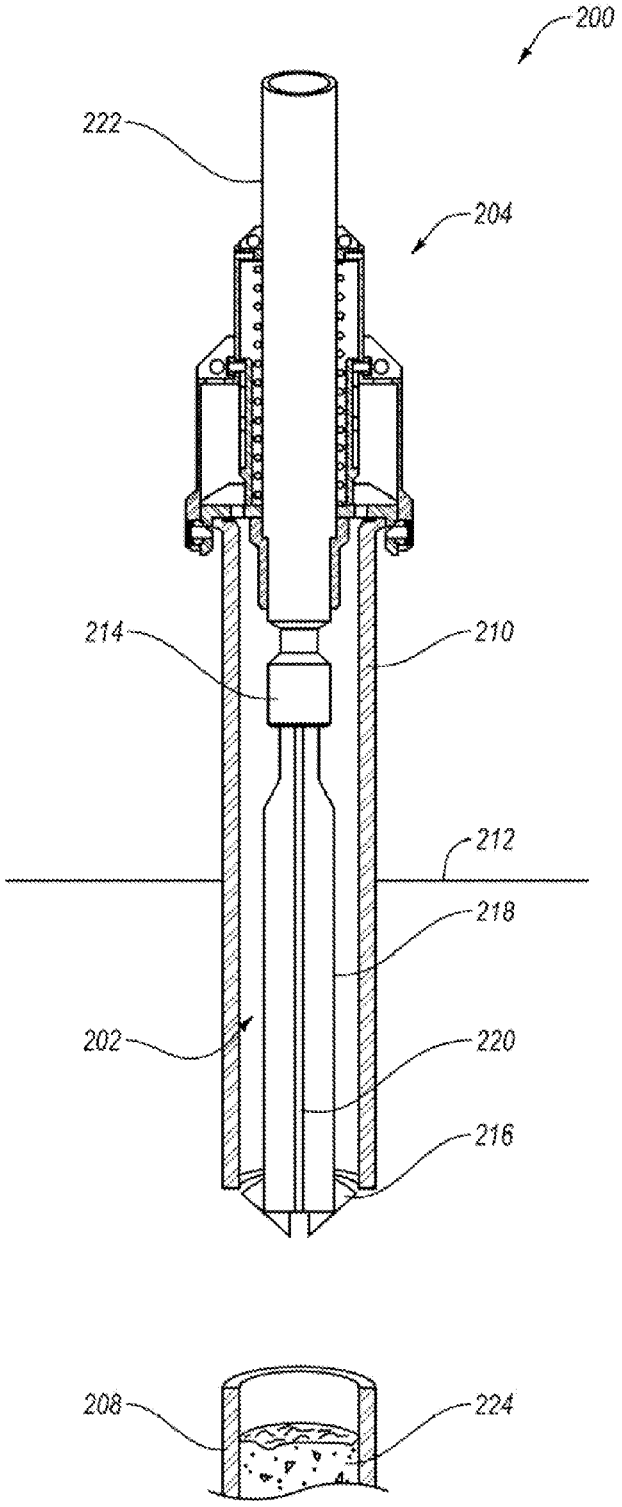
FIG. 4 illustrates a partial cross-sectional view of the cutting tool of FIGS. 2 and 3 when removing a wellhead, in accordance with some embodiments of the present disclosure.

Refining now to FIGS. 2-4, a cutting tool 200 (which may be tool 114 as shown in FIG. 1) is illustrated in accordance with some embodiments of the present disclosure. The cutting tool 200 may be used in connection with any suitable deployment system. An example deployment system for the cutting tool 200 may include a well abandonment system (e.g., well abandonment system 100 of FIG. 1) used to cut a casing, of a borehole and/or remove a wellhead. Accordingly, the cutting tool 200 may also be referred to as a well abandonment tool.

As shown in the particular embodiment illustrated in FIGS. 2-4, an example cutting tool 200 may include multiple components, assemblies, or modules. In this particular embodiment, the cutting tool 200 may include a cutting assembly 202 coupled to a latch assembly 204, in general, the cutting assembly 202 may be inserted into a borehole 206 and used to cut a casing 208 surrounding the borehole 206. The latch assembly 204 may, in turn, couple the cutting tool 200 to a wellhead 210 that provides access to the borehole 206. The latch assembly 204 may couple to the wellhead 210 before, during, or after a cutting operation performed by the cutting assembly 202. For instance, FIG. 2 illustrates the latch assembly 204 as being decoupled from the wellhead 210 for at least a time while the cutting assembly 202 is inserted into the borehole 206. In FIG. 3, however, the latch assembly 204 may engage with, and optionally coupled to, the wellhead 210 while a cutting operation is performed. In FIG. 4, the latch assembly 204 remains coupled to the wellhead 210 following a cutting operation, while the wellhead 210 is removed (i.e., retrieved) from the sea floor 212.

To perform the operations illustrated in FIGS. 2-4, the latch assembly 204 and the cutting assembly 202 may have any number of different configurations. For instance, the cutting assembly 202 may be actuated using hydraulic, electrical, or some other power source, or some combination thereof. In this particular embodiment, for instance, the cutting assembly 202 includes a motor 214 and a cutter 216. In general, the motor 214 may control rotation or other operation of the cutter 216. By way of example, the motor 214 may rotate a body 218, which can act as an output shaft for the motor 214. The cutters 216 may be coupled to the body 218, such that as the body 218 rotates, the cutters 216 also rotate. As they rotate, the cutters 216 can engage the casing 208 of the borehole (see FIG. 3) and cut the casing 208.

The cutters 216 may be formed of any material suitable for cutting the casing 208 and other service in a subsea or other environment. In one example embodiment, the cutters 216 may be formed of or include superhard materials such as tungsten carbide, cubic boron nitride, diamond-based materials (e.g., polycrystalline diamond compacts), and the like. Of course other materials, including steel, stainless steel, etc., or other materials may also be included as part of the cutters 216.

In some embodiments, the cutters 216 may be expandable. As shown in FIGS. 2-4, for instance, the cutters 216 may selectively expand radially inward or outward. When in an inward configuration as shown in FIG. 2, the outer diameter of the cutting assembly 202 may be sized to allow introduction of the cutting assembly 202 into the borehole 206. When the cutters 216 are then extended radially outward, they may engage and cut the casing 208.

Figure 5:
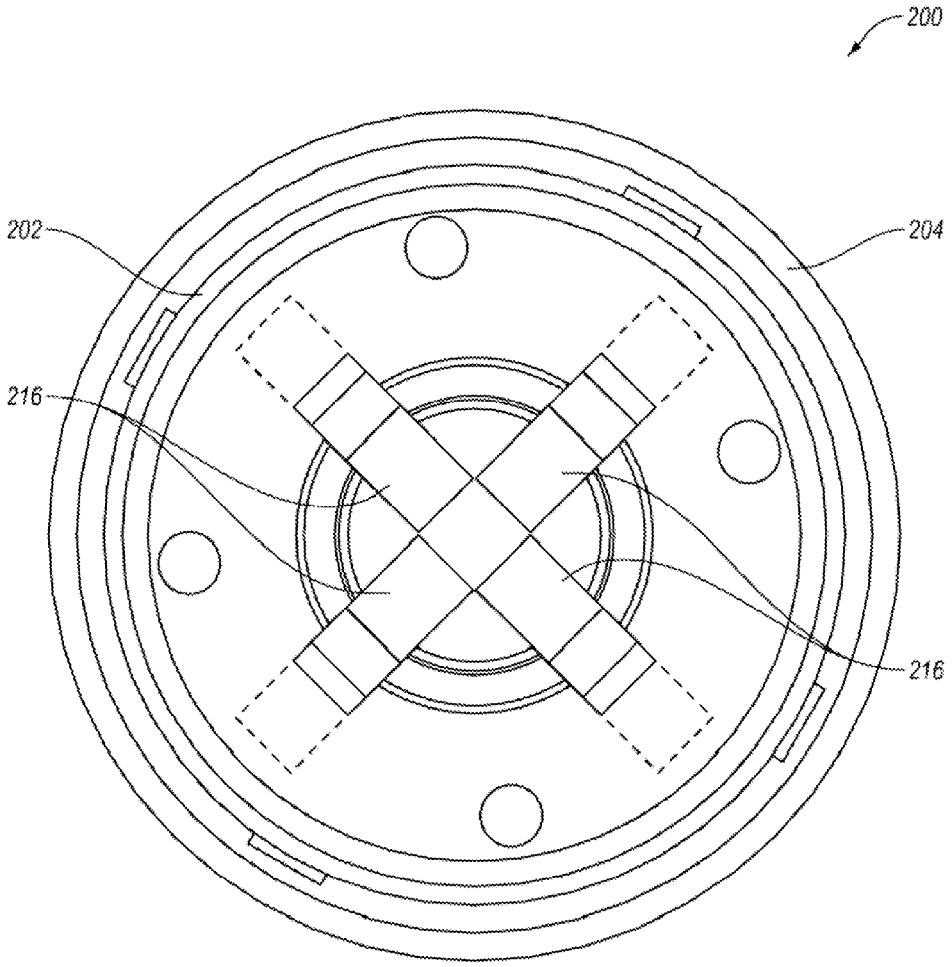
FIG. 5 illustrates a bottom plan view of the cutting tool of FIGS. 2-4, according to some embodiments of the present disclosure.

In at least some embodiments, the cutters 216 may be mechanically actuated, such as by moving the cutters 216 to a radially extended position. In other embodiments, the cutters 216 may be actuated using hydraulic pressure. For instance, hydraulic fluid may be passed through a channel 220 within the body 218 of the cutting assembly 202. The hydraulic fluid may be pressurized so that fluid flow through the channel 220 causes the cutters 216 to move radially outward. If the pressure is reduced or fluid flow stopped, the cutters 216 may move radially inward. FIG. 5 illustrates a bottom plan view of the cutting tool 200 of FIGS. 2-4, and shows the cutters 216 in a radially contracted position, with a radially expanded position shown in dashed lines. The cutting tool 200 of FIG. 5 is shown as including four cutters 216, although this embodiment is merely illustrative. In other embodiments there may be more or fewer than four cutters 216. For instance, a single cutter may be used.

Hydraulic fluid may be supplied to expand the cutters 216 in any suitable manner. For instance, the motor 214 may include or power a pump (not shown) which provides the hydraulic fluid. In another embodiment, hydraulic fluid may be provided through a conveyance system 222 (see disclosure related to conveyance system 120 of FIG. 1). The conveyance system 222 may extend to, or be in fluid communication with, a pump and fluid reservoir. In an embodiment in which the wellhead 210 is a subsea wellhead, the conveyance system 222 may extend to the surface (e.g., a surface vessel). A fluid pump at the surface may pass hydraulic fluid through an interior of the conveyance system 222 to expand the cutters 216. The conveyance system 222 may also be used to pass additional or other elements to the cutting tool 200. For instance, the conveyance system 222 may include a coolant conduit, cutting fluid conduit, electrical line, or other element used to power the motor 214, cutting assembly 202, or other element of the cutting tool 200. Conveyance system 222 may be a drill string, tubulars, or similar rigid conveyance. Conveyance system 222 may also be an umbilical line, coiled tubing, wireline, or similar flexible conveyance.

Optionally, the expansion of the cutters 216 may be controllable. For instance, the cutters 216 may be partially expanded, to extend radially to a position between an innermost position and an outermost position (see FIG. 5). Selective radial expansion may allow the cutters 216 to be used in connection with cutting casings 208 of differing sizes. In one embodiment, the casing 208 that may be cut by the cutting assembly 202 may have a diameter between about eight inches (203 mm) and about thirty six inches (914 mm). In a more particular example, the casing 208 that may be cut by the cutting assembly 202 may have a diameter varying between about twelve inches (305 mm) and about twenty inches (508 mm). For instance, the casing 208 may have a diameter of about sixteen inches (406 mm). In still other embodiments, the casing 208 may be larger than 36 inches (914 mm) or less than eight inches (203 mm).

While the cutting tool 200 may have cutters 216 that can be selectively expandable or used in connection with casings 208 of differing sizes, other embodiments may include a cutting tool 200 of some other configuration. Moreover, the manner in which the cutting assembly 202 operates may vary. For instance, as discussed herein, the motor 214 may use electrical or hydraulic power. In one embodiment, the motor 214 may be a mud motor that uses hydraulic power. In other embodiments, the motor 214 may be electrical and use an electrical line provided through the conveyance system 222. In still other embodiments, motor 214 may be or include a turbine. A combination of electrical and hydraulic power may also be used.

Regardless of the particular type of motor 214 used, the motor 214 may have sufficient power for use with the cutting assembly 202. In the case of an example hydraulic motor, hydraulic fluid flowing between about 0 and 3000 gpm (0 and 189 L/s) may be used by the motor 214. In a more particular embodiment, the motor 214 may use hydraulic fluid at a flow rate between about 0 and 1000 gpm (0 and 63 L/s), or about 0 and 500 gpm (0 and 32 L/s).

Whether the motor 214 is an electrical, hydraulic, or other type of motor, it may provide sufficient torque to rotate the cutting assembly 202 and/or the cutters 216 to cut the casing 208. In one embodiment, up to about 25,000 lb-ft (33,900 Nm) of torque are provided. In another embodiment, up to about 15,000 lb-ft (20,350 Nm) of torque are provided.

The amount of torque and power provided or used may vary based on the size and other configuration of the cutting tool 200. In one embodiment, the cutting tool 200 may have a length up to about ninety feet (27.4 m). In a more particular embodiment, the length of the cutting tool 200 may between about twenty feet (6.1 m) and seventy feet (21.3 m), or between about thirty-five feet (10.7 m) and about forty five feet (13.7 m). Of course, in other embodiments, the cutting tool 200 may be longer then ninety feet (27.4 m).

As shown in FIG. 4, the cutting assembly 202 may generally be sized to extend into the borehole 206 a sufficient distance to allow the cutters 216 to cut the casing 208 below the borehole and above a borehole plug 224. Once the casing 208 is cut or severed, the wellhead 210 (and an upper portion of the casing 208) may be separated from the lower portion of the casing 208. In FIG. 4, the wellhead 210 may be separated and removed using the latch assembly 204. In general, the latch assembly 204 may include a wellhead connector that is secured to the wellhead 210. While secured, a lift system or other device (e.g., lift system 112 of FIG. 1) may pull the conveyance system 222. As an upwardly directed force is applied to the conveyance system 222, the cutting tool 200 may move upward, and carry the wellhead 210 therewith.

Figure 6:
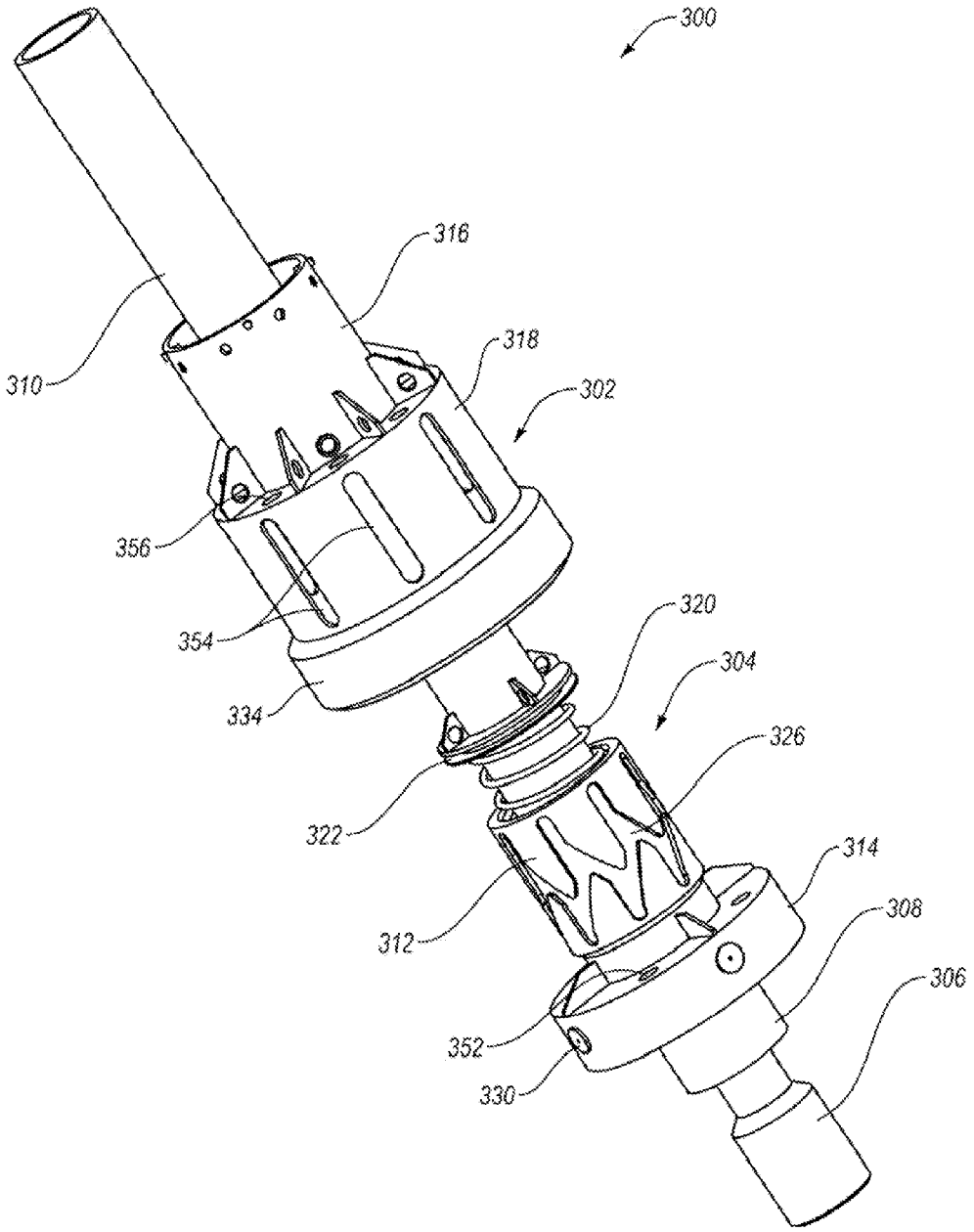
FIG. 6 illustrates an exploded, perspective view of a wellhead latch assembly, in accordance with some embodiments of the present disclosure.
Figure 7:
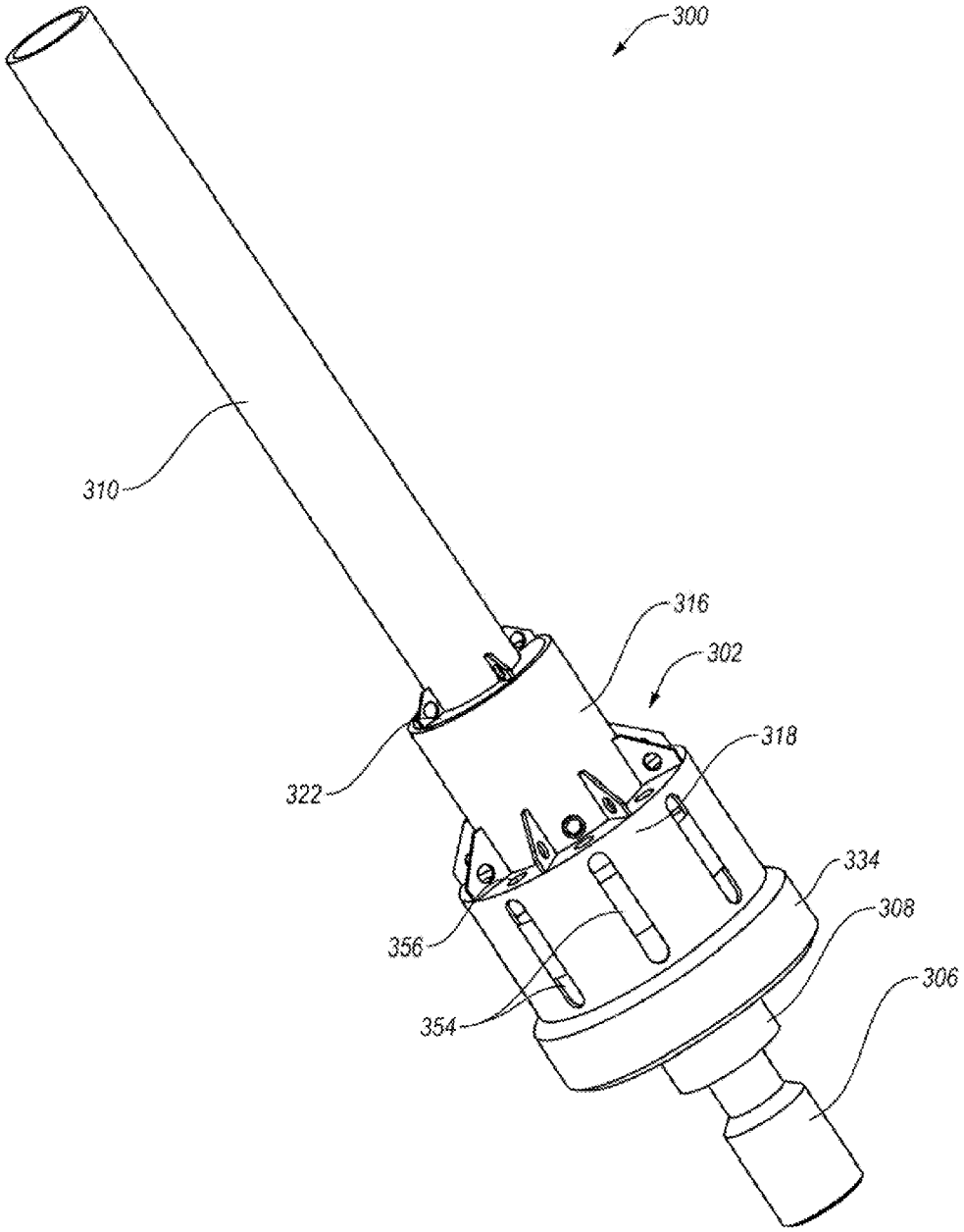
FIG. 7 illustrates a perspective view of an assembled wellhead latch assembly, according to some embodiments of the present disclosure.
Figure 8:
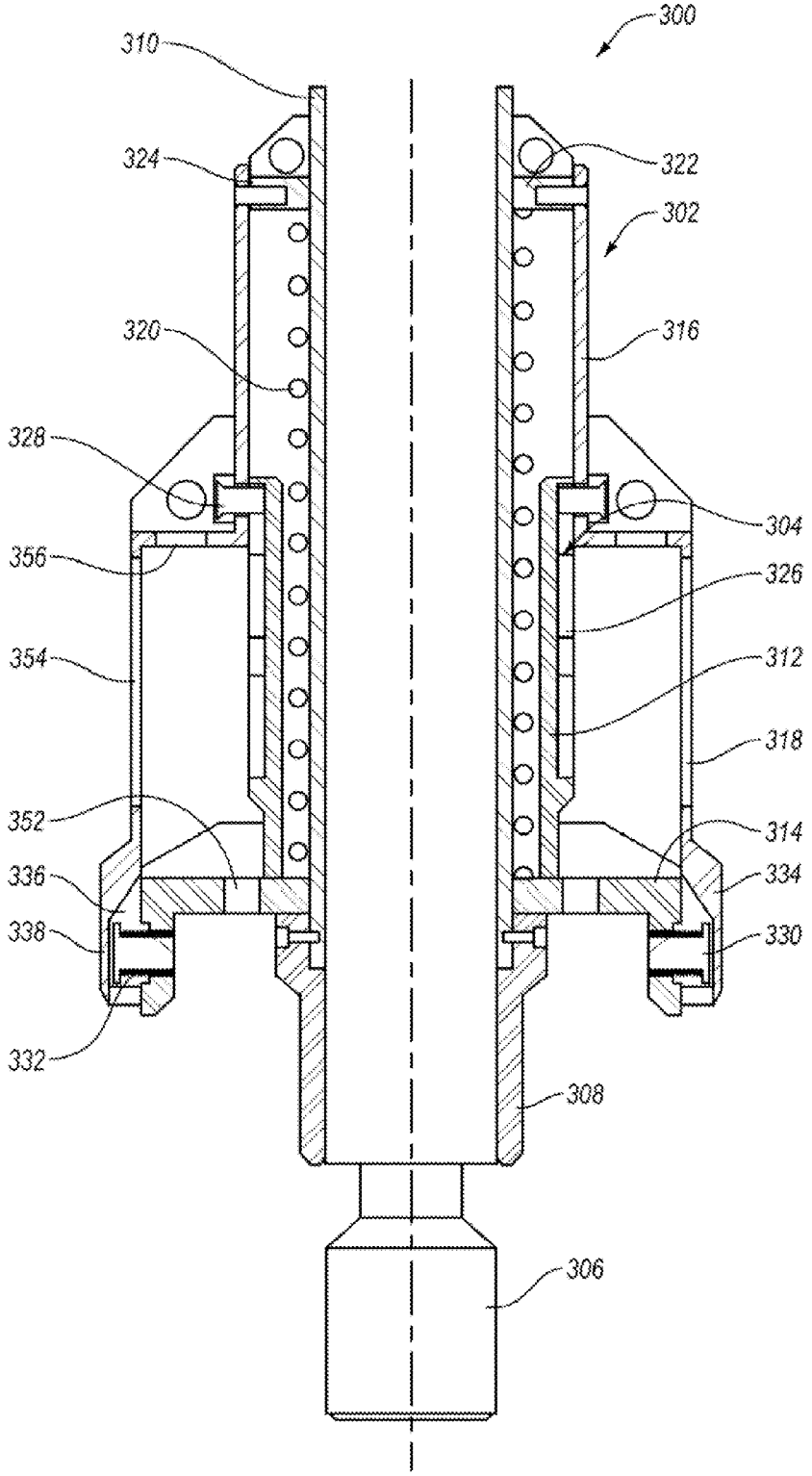
FIG. 8 illustrates a cross-sectional view of the assembled wellhead latch assembly of FIG. 6, according to some embodiments of the present disclosure.

One particular embodiment of a wellhead latch assembly 300 (e.g., latch assembly 204 of FIGS. 2-4) that may be secured to a wellhead (e.g., wellhead 104 of FIG. 1 and wellhead 210 of FIGS. 2-4) is shown in greater detail in FIGS. 6-8. In particular, FIG. 6 provides an exploded view of various components of the wellhead latch assembly 300. FIGS. 7 and 8 provide perspective and cross-sectional views, respectively, of the wellhead latch assembly 300 when the various components are in an assembled configuration.

In this example embodiment, the wellhead latch assembly 300 may include an outer sleeve 302 that mates with an inner core 304. Various additional components may be included. For instance, the illustrated wellhead latch assembly 300 may include or couple to a motor 306, which in this embodiment may couple to the inner core 304 via a motor adapter 308. A conveyance system 310 may also couple to the motor 306 and/or the inner core 304. In one embodiment, the conveyance system 310 may be used for providing power to the motor 306. For instance, the conveyance system 310, as with the conveyance system 120 of FIG. 1 and the conveyance system 222 of FIG. 2, may include a pipe, conduit, drill string, tubulars, or similar rigid conveyance or may include an umbilical line, coiled tubing, wireline, or similar flexible conveyance. Hydraulic fluid or an electrical line may pass through the conveyance system 310 and to the motor 306 which may then be used to provide a rotational output. The rotational output may drive any suitable rotary tool, including, but not limited to, a tool for cutting a borehole casing (e.g., cutting assembly 202 of FIG. 3).

As shown in FIGS. 7 and 8, when the wellhead latch assembly 300 is assembled, the outer sleeve 302 may enclose or otherwise extend around at least a portion of the inner core 304. In one embodiment, the periphery of the inner core 304 is fully, or substantially, enclosed or covered by the outer sleeve 302. The particular position of the outer sleeve 302 relative to the inner core 304 may, however, be varied. Indeed, in some embodiments, the outer sleeve 302 and the inner core 304 may move relative to each other, even when assembled. For instance, the outer sleeve 302 may move axially along, or rotate around, a longitudinal axis of the wellhead latch assembly 300. More particularly, some embodiments may include an outer sleeve 302 that encloses at least some, and potentially the entirety, of the inner core 304 in at least some positions or orientations (see FIGS. 7 and 8), while other embodiments may have an inner core 304 that is at least partially visible or accessible in at least some positions or orientations of the outer sleeve 302.

In one embodiment, the shapes of the inner core 304 and outer sleeve 302 are complementary to allow the coupling, of the inner core 304 and the outer sleeve 302. For instance, the inner core 302 may be made up of multiple sections or portions. In this particular embodiment, the inner core 302 may include a slotted body 312 and a shoulder 314. The slotted body 312 and shoulder 314 may each be generally cylindrical in shape, with the shoulder 314 having a larger outer diameter as compared to the slotted body 312. The shoulder 314 and slotted body 312 may also have an interior opening sized or otherwise configured to allow the conveyance system 310 to extend therethrough. Optionally, the size of the interior of the shoulder 314 may be sized to be about equal to the outer diameter of the conveyance system 310. In at least some embodiments, the conveyance system 310 is able to move within the opening in the shoulder 314. In other embodiments, however, a threaded connection, mechanical fastener, or other component, or some combination thereof, may be used to couple or fix the shoulder 314 to the conveyance system 310.

The outer sleeve 302 may also have multiple portions to match the portions of the inner core 304. In this particular embodiment, the outer sleeve 302 may include a sleeve body 316 coupled to a skirt 318. As seen in FIG. 8, the sleeve body 316 may have an interior opening sized to receive the slotted body 312 of the inner core 304 therein. Similarly, the skirt 318 may define an interior opening sized to receive the shoulder 314 therein. In some embodiments, the interior diameter of the skirt 318 may be about equal to, or slightly larger than, the outer diameter of the shoulder 314. The interior diameter of the sleeve body 316 may also be about equal to, or slightly larger than, the outer diameter of the slotted body 312. In accordance with some embodiments of the present disclosure, the size of the interior of the outer sleeve 302 may therefore allow the outer sleeve 302 to move relative to the inner core 304 and/or allow the inner core 304 to move within the interior of the outer sleeve 302.

Movement of the outer sleeve 302 or the inner core 304 relative to each other may be enabled in a number of different manners. In at least one embodiment, such movement may be controlled or restricted in some manner. For instance, FIGS. 6-8 illustrate an example in which the wellhead latch assembly 300 includes a biasing member 320. In this particular embodiment, the biasing member 320 may include a helical spring positioned between the outer circumferential surface of the conveyance system 310 and the interior surface of the slotted body 312 of the inner core 304. The biasing member 320 may also be positioned within the interior of the sleeve body 316.

The biasing member 320 may be used to provide an axial force that biases the outer sleeve 302 upward relative to the inner core 304. For instance, the biasing member 320 may engage or couple to a lower surface of a cap 322 which is in this embodiment located proximate an upper end portion 324 of the outer sleeve 302. The biasing member 320 may also extend to and engage or couple to an upper surface of the shoulder 314 of the inner core 304 (see FIG. 8). When the cap 322 is coupled to the outer sleeve 302, the biasing member 320 may therefore tend to push the upper end portion 324 of the outer sleeve 304 away from the shoulder 314. Of course, the biasing member 320 may also have other configurations, include components in addition to, or other than, the spring, or be coupled to the inner core 304 and/or outer sleeve 302 in other manners.

In the particular embodiment illustrated in FIGS. 6-8, the force exerted by the biasing member 320 may be overcome by placing a downward, axial force on the outer sleeve 302. For instance, the cap 322 may be coupled to the conveyance system 310. As a downward force is exerted on the conveyance system 310 (e.g., tubulars or other rigid conveyance), a corresponding force may be exerted on the outer sleeve 302. If the inner core 304 is positioned to resist downward movement e.g., by being placed against a wellhead as discussed in greater detail hereafter), the outer sleeve 302 may move downward relative to the inner sleeve 304, and can compress the biasing member 320.

To further control or restrict movement of the outer sleeve 302 relative to the inner core 304, the wellhead latch assembly 300 may also include a groove or slot 326 formed in the slotted body 312 of the inner core 304. More particularly, the outer sleeve 302 can include a pin 328 as shown in FIG. 8. The pin 328 may be positioned within the groove 326. As a result, when a downward force is exerted on the outer sleeve 302, the pin 328 may move from an upper end portion of the groove 326, and toward a lower end portion of the groove 326. Upon reaching the lower end portion of the groove 326, further axial movement of the outer sleeve 302 relative to the inner core 304 may be restricted. If the force on the conveyance system 310 or outer sleeve 302 is released or reduced, the biasing member 320 may expand to move the pin 328 upward within the groove 326. The term "pin" should be broadly interpreted to include rollers, integral pins, detachable pins, or other features that may be used to follow the groove 326.

The groove 326 may have any suitable shape, configuration, or other construction. The particular groove 326 illustrated in FIG. 6 may be a J-groove that extends in both circumferential and axial directions around the outer surface of the slotted body 312. In one embodiment, such a configuration may allow axial movement of the outer sleeve 302 to enable rotational movement of the outer sleeve 302 relative to the inner core 304. A more particular illustration of the groove 326 of FIGS. 6-8 is shown in greater detail in FIG. 9. In this particular embodiment the groove 326 is illustrated as if flattened as part of a planar body rather than as part of the cylindrically-shaped slotted body 326 of the inner core 304.

Figure 9:
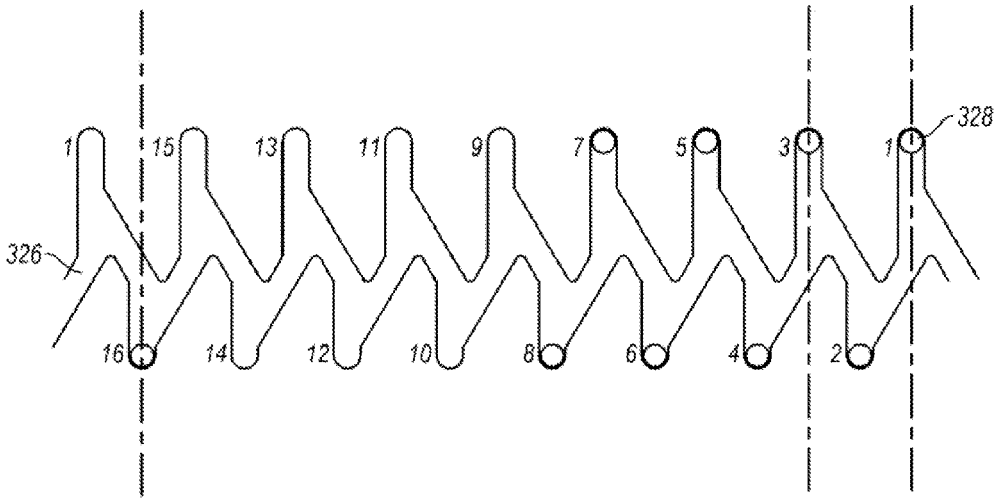
FIG. 9 schematically illustrates a groove of a wellhead latch assembly and example pin positions with the groove, according to some embodiments of the present disclosure.

As further shown in FIG. 9, the pin 328 may be positioned and move within the groove 326. When moving within the groove 326, the pin 328 may alternate between upward and downward positions. For instance, the pin 328 may start in position 1 illustrated in FIG. 9. As a downward axial force is applied, the pin 328 may move to position 2. Thereafter, when the force is released, the pin 328 may move upward and follow the groove 326 to stop at position 3. The same process may be repeated by applying and releasing a force, e.g., a downward force. When such force is applied, the pin may move to an even numbered position 2-14, whereas when the force is released, the pin may move to an odd numbered position 1-15. Because the groove 326 may be continuous, the pin 328 may ultimately reach the same position 1 where it started.

As will be appreciated in view of the disclosure herein, each upper position may be circumferentially offset relative to each lower position. In this particular embodiment, there may be eight different upper and lower positions where the pin 328 may be located. As a result, each upper position may be offset about forty-five degrees relative to each other upper position. Similarly, each lower position may be offset at about forty-five degrees relative to each other lower position. Although merely optional, the lower positions may also each be circumferentially offset from each upper position. In FIG. 9, for instance, each lower position (e.g., position 2) may be about twenty-two and one half degrees offset from an adjacent upper position (e.g., position 1).

By virtue of the upper and lower positions being circumferentially offset, as the pin 328 follows or travels within the groove 326, the cycling of axial forces on the outer sleeve 302 (FIG. 6) may rotate the outer sleeve 302 relative to relative to the inner core 304 (FIG. 6). More particularly, a loading cycle may include the application of a force, and the subsequent release of that force. In the context of the illustration in FIG. 9, such a loading cycle may move the pin 328 from position 1 to position 2 upon the application of force, and then from position 2 to position 3 upon the release of the force. Inasmuch as the circumferential offset between positions 1 and 3 is forty-five degrees in this embodiment, the loading cycle may also result in the outer sleeve 302 coupled to the pin 328 rotating forty-five degrees relative to the inner core 304 in which the groove 326 is formed. When eight loading cycles are completed in the illustrated embodiment, the pin 328 may complete a full revolution of three hundred sixty degrees and return to its original position.

In view of the disclosure herein, it should be appreciated by a person having ordinary skill in the art that cycling of axial loads may therefore be used with a wellhead latch assembly 300 to rotate various components relative to each other. In accordance with some embodiments of the present disclosure, rotation of the various components may be used to selectively engage or disengage a wellhead latch assembly 300 with a wellhead 340.

Returning now to FIGS. 6-8, an example manner in which rotation of the outer sleeve 302 may be used to latch the wellhead latch assembly 300 to a wellhead 340 is disclosed in additional detail. In such an embodiment, the inner core 304 may include latches 330, which in this embodiment are illustrated as dogs. In accordance with one embodiment, the latches 330 may be coupled to the shoulder 314. Optionally, the latches 330 may be radially expandable relative to the shoulder 314. As shown in FIG. 8, the illustrated latches 330 may include a spring 332 or other biasing member which, in this embodiment, biases the latches 330 in a radially expanded position. The latches 330 may be moveable to a retracted position (not shown) in which the latches 330 may extend inwardly of the shoulder 314. When inwardly of the shoulder 314, the latches 330 may engage and/or latch with a wellhead 340 as described in greater detail hereafter.

As shown in FIG. 8, the latches 330 may be in an expanded position that is accommodated by the outer sleeve 302. In this particular embodiment, the skirt 318 is shown as including a collar 334 that may be aligned with, and enclose, the latches 330. More particularly, one or more cut-outs 336 within the collar 334 may align with the latches 330. The cut-outs 336 may extend into the collar 334 and provide an open space that allows the latches 330 to expand radially outward within a corresponding cut-out 336. The term "cut-out" is intended to broadly include depressions, openings, removed material, or other features that allow space in the collar 334 to allow the latches 330 to expand radially outward.

In this particular embodiment, the cut-outs 336 and collar 334 may be located at or near a lower end portion 338 of the outer sleeve 338. Optionally, the cut-outs 336 may align with the latches 330 when the pins 328 are in a desired location within the grooves 326. In FIG. 9, for instance, the pins 328 may be in uppermost positions e.g., position 1 of FIG. 9) when the latches 330 align with the cut-outs 336.

As discussed herein, the outer sleeve 302 may move axially relative to the inner core 304. In accordance with some embodiments, the outer sleeve 302 may move downward from the position illustrated in FIG. 8. When the outer sleeve 302 moves downward (which may also include an optional rotation of the outer sleeve 302 as discussed herein), the latches 330 may out of the cut-outs 336. In FIG. 8, for instance, the cut-outs 336 are illustrated has having a tapered upper end portion to transition the latches 330 out of the cut-outs 336. When the latches 330 move out of the cut-outs 336, the latches 330 may no longer have space to remain in an expanded position. As a result, the latches 330 may move radially inward relative to the shoulder 314. A wellhead (not shown) may be located inwardly of the shoulder 314. Optionally, when the latches 330 move inwardly, they may engage or capture the wellhead and/or become latched thereto. Additionally, while the latches 330 may move in a purely radial direction, other movements are also contemplated. For instance, the latches 330 may move in an axial direction. Accordingly, movement of the latches 330 between latched and released positions may in some embodiments include a radial component and an axial component or may include movement in solely a radial direction, or even movement in a purely axial direction.

Figure 10:
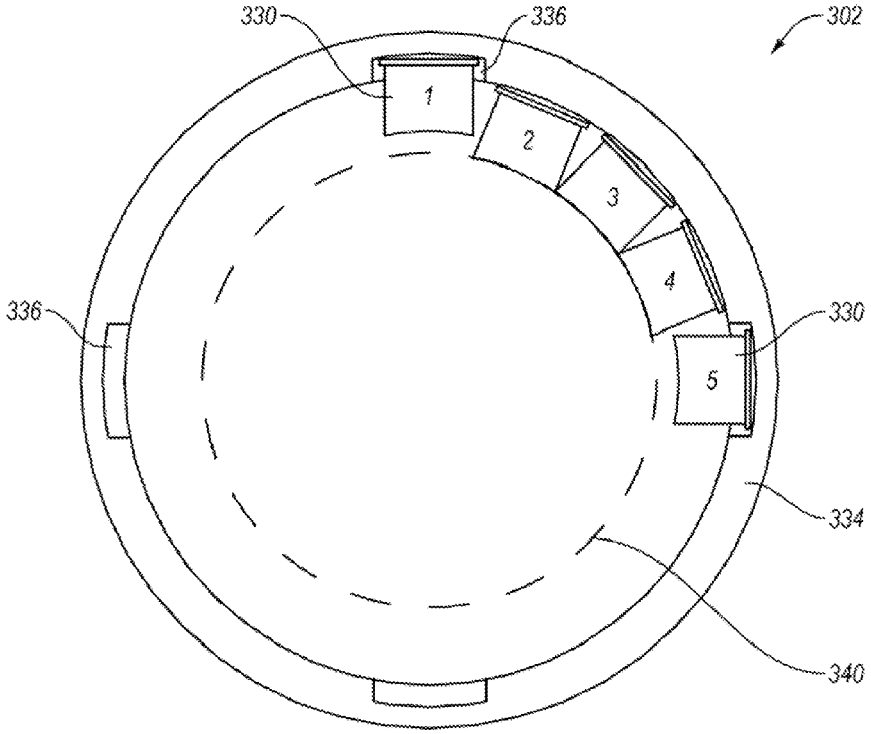
FIG. 10 schematically illustrates a bottom plan view of a wellhead latch assembly having latching elements entering in and out of alignment with sleeve cut-outs, in accordance with some embodiments of the present disclosure.

FIG. 10 schematically illustrates an example movement of an outer collar 302 which may cause the latches 330 to latch to a wellhead 340. In this particular embodiment, various positions 1-5 of a single latch 330 are illustrated. Each position 1-5 may optionally correspond to a position 1-5 of a pin 328 within a groove 326 as illustrated in FIG. 9. In the example embodiment of FIG. 10, the latch 330 may initially be aligned with a cut-out 336 in a collar 334, skirt 318, or other component of the outer sleeve 302. In such an embodiment, which is here shown as position 1, the cut-out 336 may provide sufficient space to allow the latch 330 to expand radially outward. When expanding radially outward, an inwardly facing side of the latch 330 may become unlatched from the wellhead 340.

The outer sleeve 302 may then rotate and/or move longitudinally relative to the latch 330. When the sleeve 302 translates and/or rotates, the latch 330 may move out of the cut-outs 336 to the positions illustrated as positions 2-4. As shown in FIG. 10, the latch 330 at positions 2-4 may not have sufficient space to move radially outward. As a result, the latch 330 may be maintained in a radially inward position. At such a position, the latch 330 may engage and/or latch with the wellhead 340. As the latch 330 may not be able to expand radially outward, the latch 330 may engage the wellhead 340 in a manner that latches the wellhead latch assembly, or components thereof, to the wellhead 340. In the particular embodiment illustrated in FIG. 10, the outer sleeve 302 may include multiple cut-outs 336. As a result, continued rotational movement and/or axial movement of the outer sleeve 302 may cause the latch 330 to again align with a corresponding cut-out 336, as shown by position 5. At position 5, the latch 330 may again expand radially outward and into the cut-out 336, thereby disengaging or unlatching the wellhead 340.

While FIG. 10 illustrates an example with a single latch 330 that moves between five positions, and an outer sleeve 302 with four cut-outs 336, such an embodiment is merely illustrative. In other embodiments, more or fewer cut-outs 336 could be provided. Further, a wellhead latch assembly may also include more latches 330. Optionally, the number of latches 330 may be equal to the number of cut-outs 336, although the number of latches 330 and cut-outs 336 may vary in other embodiments to have more or fewer latches 330 than cut-outs 336. The cut-outs 336 may be circumferentially offset around the outer sleeve 302. The angular or circumferential offset between respective cut-outs 336 may be equal for each cut-out 336, although in other embodiments the circumferential offsets may vary.

An example manner in which the latches 330 may be used in connection with a wellhead 340, and secured thereto, may be more fully appreciated by reference the embodiments of FIGS. 11-14. More particularly, FIGS. 11-14 may generally represent an example manner in which the wellhead latch assembly 300 may be latched to the wellhead 340 by rotating an outer sleeve 302 using a groove 326 as discussed herein. In general, the embodiments illustrated in FIGS. 11-14 may correspond to the configuration of the wellhead latch assembly 300 when a pin 328 is at a respective position 1-4 within the groove 326, as shown in FIG. 9.

The wellhead latch assemblies 300 of FIGS. 11-14 may generally be similar to the embodiments of a wellhead latch assembly as described herein. Accordingly, to avoid unnecessarily obscuring aspects of the present disclosure, certain features may not be described, but may have the same configuration or operation as described elsewhere herein.

Figure 11:
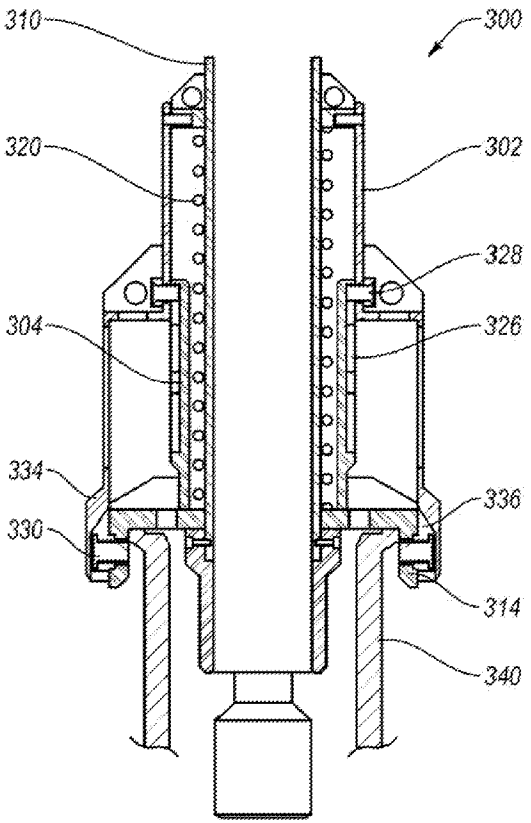

FIG. 11 generally illustrates a wellhead latch assembly 300 that includes the same configuration as the wellhead latch assembly 300 of FIG. 8, except that the inner core 304 has been aligned with, and placed on top of, a wellhead 340. In particular, in this embodiment the inner core 304 includes a shoulder 314 having an outer diameter larger than the outer diameter of the wellhead 340. An opening within the shoulder 314 may also be about the same size as, or larger than, the outer diameter of the wellhead 340. As a result, the wellhead 340 may be positioned inwardly relative to shoulder 314. The latches 330 of the inner core 304 may also be in a radially expanded position within cut-outs 336 in a collar 334 of the outer sleeve 302. Such positioning may allow the shoulder 314 to slide over the top of the wellhead 340 with little or no interference from the latches 330.

As shown in FIG. 11, the wellhead latch assembly 330 may be in an extended (i.e., unretracted) position when initially aligned with the wellhead 340. In the example embodiment, a biasing member 320 may be expanded, and the outer sleeve 302 may be at an upward position relative to the inner core 304. The particular position of the outer sleeve 302 relative to the inner core 304 may be at least partially controlled or limited by one or more pins 328 of the outer sleeve 302, which pins 328 may travel within one or more grooves 326 within the slotted body of the inner core 304 to allow rotational and/or translational movement of the outer sleeve 302 relative to the inner core 304.

Figure 12:
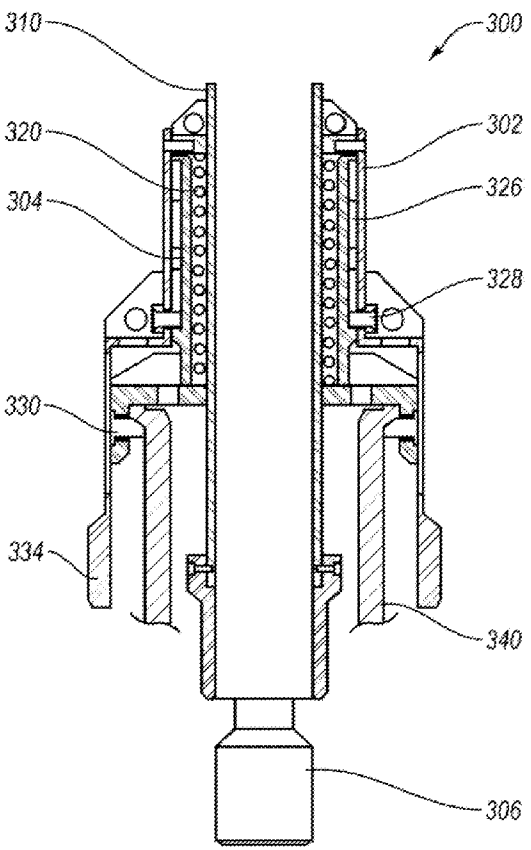
FIGS. 11-14 illustrate cross-sectional views of an example process for coupling the assembled wellhead latch assembly of FIGS. 7 and 8 to a wellhead, in accordance with some embodiments of the present disclosure.

The outer sleeve 302 may also be coupled to conveyance system 310, which is illustrated in this embodiment as including a pipe or tubular. In accordance with some embodiments of the present disclosure, the conveyance system 310 may be used to move the outer sleeve 302 relative to the inner core 304. For instance, the conveyance system 310 may be formed of a rigid or semi-rigid material capable of transferring a load to or downward force on the wellhead latch assembly 300. In such an embodiment, when a downwardly directed, compressive force is applied to the conveyance system 310, the force may be transferred to the outer sleeve 302. The outer sleeve 302 may therefore be in an expanded or decompressed (i.e., compressible) position that allows downward movement of the outer sleeve 302 to thereby compress the biasing member 320. When the inner core 304 rests against the wellhead 340, the wellhead 340 may prevent or restrict movement of the inner core 304. The inner core 304 may therefore remain relatively stationary, and the biasing member 320 may be compressed between the inner core 304 and the outer sleeve 302 (in its compressed position). FIG. 12 illustrates an example embodiment in which the outer sleeve 302 has been moved relative to the inner core 304. In particular, the biasing member 320 has been compressed and the pin 328 has moved downward within the groove 326. In the particular embodiment shown in FIG. 12, the outer sleeve 302 may be in a compressed (i.e., expandable) position that resists further compressive forces. Such resistance may be provided by the biasing member 320 and/or the inner core 304.

As a result of moving the outer sleeve 302 relative to the inner core 304, the latches 330 may also be placed out of alignment relative to the cut-outs 326. As shown in FIG. 12, for instance, the collar 334 may no longer be in alignment with the latches 330. Consequently, the latches 330 may translate radially inward. In this particular embodiment, by moving the latches 330 radially inward, the latches 330 may engage the wellhead 340 and become latched thereto. In such a position, the entire wellhead latch assembly 300 may be latched to the wellhead 340. Accordingly, the embodiment in FIG. 12 illustrates an example of the latches 330 in a latched position with the wellhead 340, while FIG. 11 illustrates the latches 330 in a released position relative to the wellhead 340.

Either before or after latching the wellhead latch assembly 300 to the wellhead 340, a downhole operation may be performed. In this particular embodiment, a motor 306 may be included and can operate in connection with a rotary tool (see, e.g., FIG. 2). An example rotary tool may be a cutting tool that can cut a borehole casing (see, e.g., FIG. 2). When the borehole casing is cut or severed, the wellhead 340 and an upper portion of borehole casing may be separable from a lower portion of borehole casing. The wellhead latch assembly 300 may be used to remove or retrieve the wellhead 340. For instance, in the configuration shown in FIG. 12, the wellhead latch assembly 300 may be latched or otherwise secured to the wellhead 340. By exerting an upward force on the conveyance system 310, an operator may begin to remove the wellhead. The wellhead latch assembly 300 may therefore include or be part of a well abandonment tool.

Figure 13:
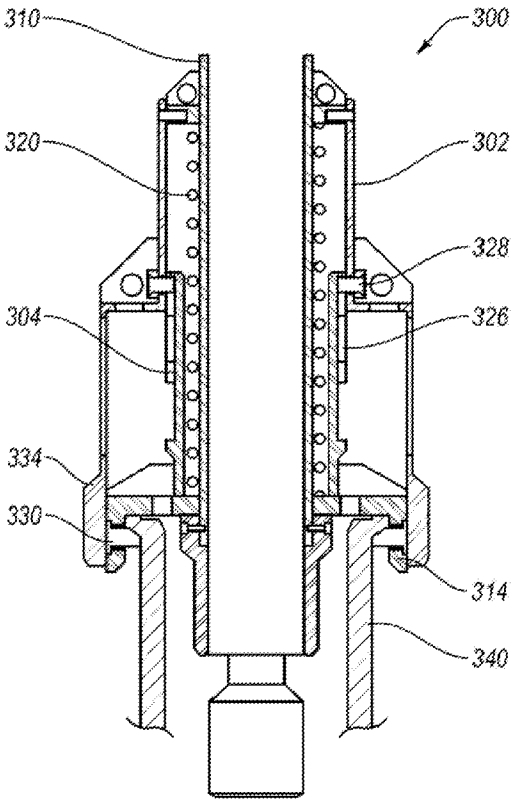

In some embodiments, when an upward force is exerted, or when a downward force is released, the outer sleeve 302 may again move relative to the inner core 304. As shown in FIG. 13, for instance, the biasing member 320 may expand and the outer sleeve 302 may move from the expandable position shown in FIG. 12 to another compressible position allowing compression of the biasing member 320. Such movement may occur with the pin 328 travels to an upward location within the groove 326. When the pin 328 reaches the top of the groove 326, the latches 330 may generally be in axial alignment with the collar 334 of the outer sleeve 302. In this embodiment, however, the latches 330 may not be able to expand radially outward and may instead remain engaged with the wellhead 340. More particularly, as discussed above, the groove 326 may include circumferential features. Thus, by cycling the outer sleeve 302 and causing it to move downward to the expandable position in FIG. 12 and again upward to the compressible position in FIG. 13, the outer sleeve 302 may have rotated. As a result, the circumferentially offset cut-outs 336 of FIG. 11 (see also FIG. 10) may no longer be aligned with the latches 330. Accordingly, FIG. 13 illustrates another example of the latches 330 in a latched position. In some embodiments, the cut-outs 336 and the latches 330 may be about forty-five degrees out of alignment; however, such an embodiment is merely illustrative.

If an upward force is applied to the conveyance system 310 when the wellhead latch assembly 300 is in the position illustrated in FIG. 13, the pins 328 remain engaged with the inner core 304, and the outer sleeve 302 and inner core 304 remain coupled. If the wellhead 340 has been detached/severed from at least a portion of the casing of a borehole, the wellhead 340 may then remain latched to the wellhead latch assembly 300 as they collectively are retrieved. If the wellhead 340 has not been detached/severed from at least a portion of the casing of a borehole, an upward force may be used to determine whether or not the wellhead latch assembly 300 is latched in place. Indeed, if an attempt is made to lift the wellhead latch assembly 300, the wellhead 340 latched thereto may resist the lift. A remote operator can measure or sense the resistance, and may therefore determine that the wellhead latch assembly 300 has successfully latched to the wellhead 340, potentially without the use of subsea sensors, a remotely operated vehicle, other device, or some combination thereof. One feature of the wellhead latch assembly 300 may therefore include the ability to efficiently couple mechanical latches 330 to/about the wellhead 340 and to verify the integrity of the coupling.

Figure 14:
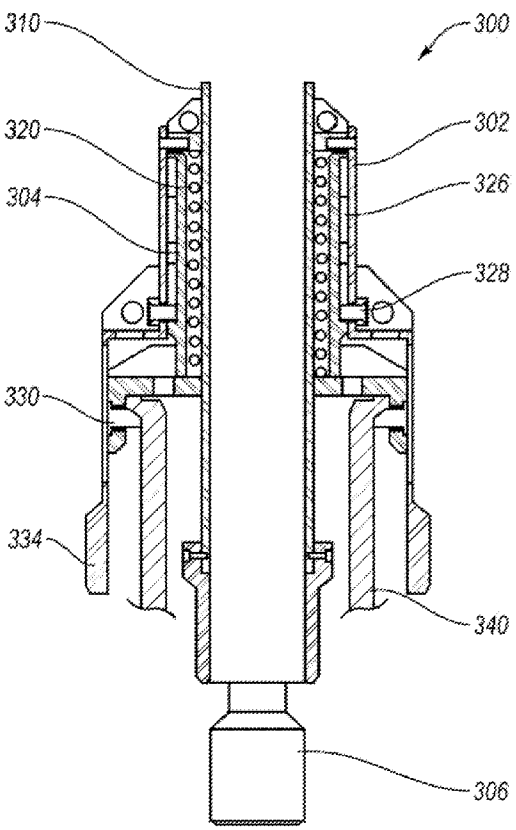

Although a single loading, cycle may be used in some embodiments to latch the wellhead latch assembly 300 to the wellhead 340, multiple loading cycles may be used in other embodiments. Accordingly, as shown in FIG. 14, the conveyance system 310 may again be used to downwardly move the outer sleeve 302 and compress the biasing member 320 (e.g., from a compressible position shown in FIG. 13 to the expandable position in FIG. 14). When the pin 328 reaches the bottom of the groove 326, or potentially before such a position, the load may be released and the pin 328 may move upward within the groove 326. With another cycle complete, the wellhead latch assembly 300 may move back into a configuration such as that shown in FIG. 13, although in other embodiments rotation of the outer sleeve 302 could again rotate one or more cut-outs 326 into alignment with the latches 330 to allow the latches 330 to move into a released position and unlatch the wellhead latch assembly 300 relative to the wellhead 340.

One aspect of the present disclosure may include, as discussed herein, the use of the wellhead latch assembly 300 to engage the wellhead 340 and to latch thereto to facilitate removal of the wellhead 340. An example environment in which such as system may be used can include a subsea environment where the wellhead 340 is located at a well on the sea floor. As the wellhead 340 is lifted from the sea floor, the underwater currents and waves may exert additional forces on the wellhead 340 and the wellhead latch assembly 300. If the forces are sufficiently strong, or the coupling between the wellhead 340 and wellhead latch assembly 300 are sufficiently weak, the wellhead 340 may become dislodged and can fill back to the sea floor. Recovering the wellhead 340 in such a scenario may be difficult, which can increase the time and expense of the well abandonment process.

Various coupling mechanisms may be used to provide a sufficiently strong coupling to resist the forces placed on the wellhead 340 and/or wellhead latch assembly 300 during recovery of the wellhead 340. For instance, to provide a stronger coupling, multiple latches 330 may be used. As discussed herein, a set of four latches 330 may be offset around the inner core 304 of the wellhead latch assembly 300. For a still stronger coupling, more latches 330 may be used, or the size of latches 330 may be increased. In the same or other embodiments, the manner of coupling the wellhead latch assembly 300 to the wellhead 340 may be varied.

Figure 15:
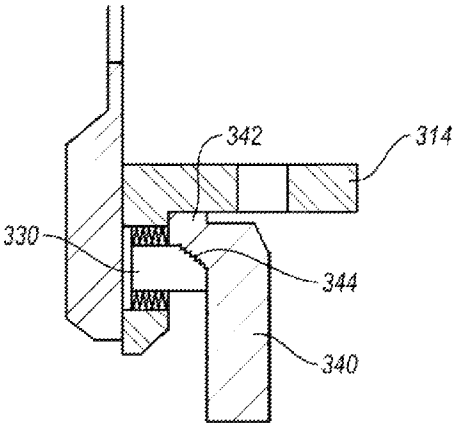
FIG. 15 illustrates an enlarged cross-sectional view of a latch element of a wellhead latch assembly, according to some embodiments of the present disclosure.

FIG. 15, for instance, illustrates provides an enlarged view of the latch 330 of FIGS. 7-14 in this particular embodiment, the latch 130 is shown as being engaged with and/or latched to the wellhead 340. More particularly, the illustrated embodiment includes a wellhead 340 that includes a flange 342 at the upper surface thereof, and which has an increased size relative to one or more other portions of the wellhead 340. When the wellhead 340 engages a shoulder 314 of a wellhead latch assembly 300, the flange 342 may align relative to latches 330 in a manner that allows the latches 330 to engage or overlap the underside of the flange 342, or to engage the body of the wellhead 340 under the flange 342. By engaging the wellhead 340 under the flange 342, the latches 330 latch the wellhead latch assembly 300 to the wellhead 340 thereby providing a secure coupling. For instance, as shown in FIG. 15, the latches 330 may extend inwardly and have an inner diameter less than the outer diameter of the flange 342, thereby making it difficult to pull upward and separate the wellhead 340 from the latches 330 or the wellhead latch assembly 300.

In some additional or other embodiments, one or more other features may also be provided to securely couple the latches 330 to the wellhead 340. FIG. 15, for instance, illustrates an embodiment in which the latches 330 include gripping elements 344 to increase frictional engagement and securement with the wellhead 340. The gripping elements 344 may include teeth, pins, anchors, compression sleeves, or other frictional elements, or some combination thereof. In the illustrated embodiment, the gripping elements 344 may grip an underside of the flange 342, and optionally an angled surface. In other embodiments, however, the gripping elements 344 may grip a horizontal underside of the wellhead 340, a vertical surface of the wellhead 340, or some combination thereof. The wellhead 340 may also have corresponding structures to facilitate use with the gripping elements 340. For instance, a textured surface, threads, grooves, or some other element may be included to further enhance the strength of the coupling between the latches 330 and the wellhead 340.

Figure 16:
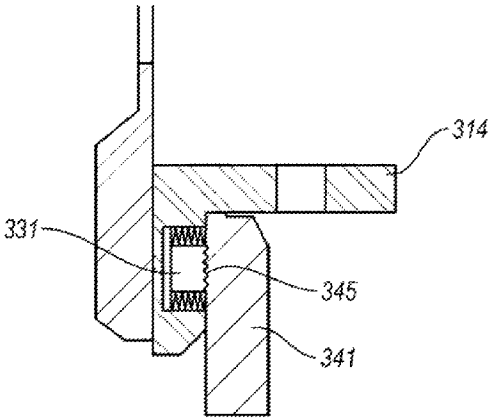
FIG. 16 illustrates an enlarged cross-sectional view of an alternative latch element of a wellhead latch assembly, according to some embodiments of the present disclosure.

Different styles and configurations of wellheads may be used, and some aspects of the present disclosure may provide for use of a wellhead latch assembly 300 with any number of different types of wellheads. FIG. 16, for instance, illustrates another embodiment in which a wellhead 341 has a different configuration. In this particular embodiment, the wellhead 341 does not include a flange adjacent the shoulder 314. Instead, the wellhead 341 may include a substantially vertical surface against which a latch 331 may be secured.

In the particular embodiment illustrated in FIG. 16, a set of one or more gripping elements 345 may be included on the latch 331 and/or wellhead 341 to facilitate a secure grip on the wellhead 341. As noted above, for instance, the gripping elements 345 may include teeth, pins, threads, textured surfaces, some other friction enhancing element, or some combination thereof. The wellhead 341 may also include corresponding structures so that frictional engagement between the wellhead 341 and latch 331 may be maintained. Further, latch 331 may engage wellhead 341 such that latch 331 acts as a lock to firmly secure the wellhead latch assembly 300 to the wellhead 341. Such locking latch may include, e.g., a dog, a pin, a bolt or the like, that is inserted into an aperture disposed within an outer surface of the wellhead 341.

In some embodiments, the same wellhead latch assembly 300 may be used for multiple different wellheads (e.g., wellheads, 340, 341). To facilitate use with multiple wellheads, the latches 330, 331 of FIGS. 15 and 16 may be interchangeable. A shoulder 314 may, for instance, allow the latches 330, 331 to be removed and other components installed.

In addition to the waves and other undersea forces affecting the grip between a wellhead and a latch (or similar device), the forces may also cause some movement within a wellhead latch assembly. For instance, returning now to FIGS. 11-14, an outer sleeve 302 may be moveable in an axial and/or rotational direction relative to an inner core 304 (e.g., between compressible and expandable positions). In some embodiments, underwater currents or waves (e.g. a so-called "100 year wave") may act on the wellhead latch assembly 300. When such a wave occurs, the wave may move the outer sleeve 302 relative to the inner core 304. If the outer sleeve 302 is compressed towards the inner core 304, and then released, the outer sleeve 302 may rotate so that cut-outs 336 align with the latches 330. If that occurs, the latches 330 may disengage the wellhead 340.

Figure 17:
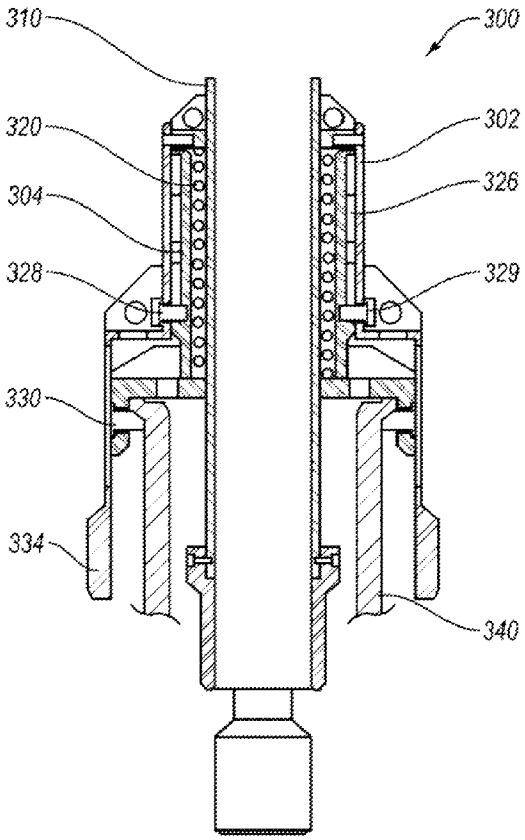
FIG. 17 illustrates a cross-sectional view of a locking system for locking axial and/or rotational movement of an outer sleeve relative to an inner core.

Various mechanisms may be used to further secure the wellhead latch assembly 300 against a 100 year wave or other underwater forces. For instance, the groove 326 may have a generally constant depth. As a result, the pin 328 may freely move or travel in the groove 326 as axial or other forces are applied. In some embodiments, however, the depth of the groove 326 may be varied at one or more locations. FIG. 17, for instance, illustrates an example configuration of a wellhead latch assembly 300 when the pin 328 is deeper within the groove 326, e.g., when the pin 328 is positioned and resides within a deeper portion of groove 326. Optionally, the illustrated position may correspond to position 16 of FIG. 9 and/or a locked position in which the outer sleeve 302 is locked to prevent or resist axial and/or rotational movement relative to the inner core 304. While FIG. 17 illustrates the outer sleeve 302 in both a locked and compressed position, a location of an increased depth of the groove 326 may occur at any suitable location along the groove 326. Thus, in other embodiments, the outer sleeve 302 may be in a locked and expanded position, or in a locked position while the outer sleeve is between fully expanded and compressed positions.

The example embodiment of FIG. 17 illustrates an aspect of the present disclosure in which the groove 326 may extend circumferentially around within a slotted body of an inner core 304. One or more pins 328, 329 of an outer sleeve 302 may ride within the groove 326. The pins 328, 329 may each be the same, or may have different structures. For instance, the pin 328 may be a roller that has a generally fixed position relative to the outer sleeve 304. In contrast, the pin 329 may be spring loaded, hydraulically actuated or otherwise radially expandable to move inward or outward relative to the outer sleeve 302. Of course, in other embodiments, both pins 328, 329 may be fixed or radially expandable. In other embodiments, the pin 329 may move in both axial and radial directions.

Along much of the length of the groove 326, the depth may be about constant and the pins 328, 329 may each be at about the same radial position relative to the outer sleeve 302, in the particular location illustrated in FIG. 17, however, the pin 329 may be located at a portion of the groove 326 having increased depth. Upon reaching such a position, the pin 329 may further move radially inward.

With the pin 329 positioned in the deeper groove 326 of FIG. 17, further movement of the outer sleeve 302 relative to the inner core 304 may be restricted. More particularly, there may be an abrupt transition between the deeper portion of the groove 326 and more shallow portions of the groove 326, such that it is difficult to remove or move the pin 329 further along groove 326 once pin 329 is positioned within the deeper portion of groove 326. The pin 329 may therefore act as a lock that locks the outer sleeve 302 in a locked position to prevent or resist further axial and/or rotational movement of the outer sleeve 302 relative to the inner core 304. At an example locked position, such as that shown in FIG. 17, the latches 330 may also be in a latched position and engaged with the wellhead 340. As the outer sleeve 302 may have its position locked relative to the inner core 304, it may be more difficult for a 100 year wave or other force to move the outer sleeve 302 and/or inner core 304, and to potentially release the latches 330.

Figure 19:
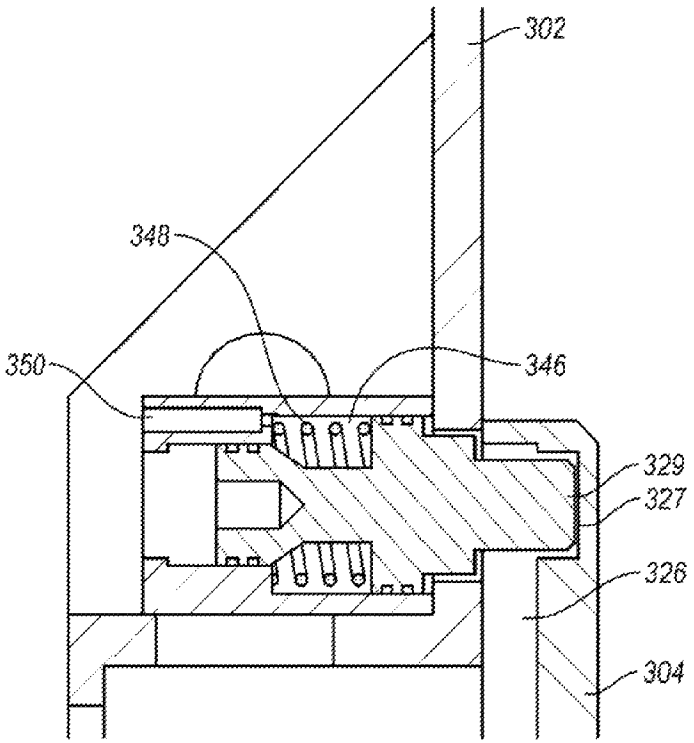
FIG. 19 illustrates a cross-sectional view of the example pin of FIG. 18, with the pin in a locked position, in accordance with some embodiments of the present disclosure.
Figure 18:
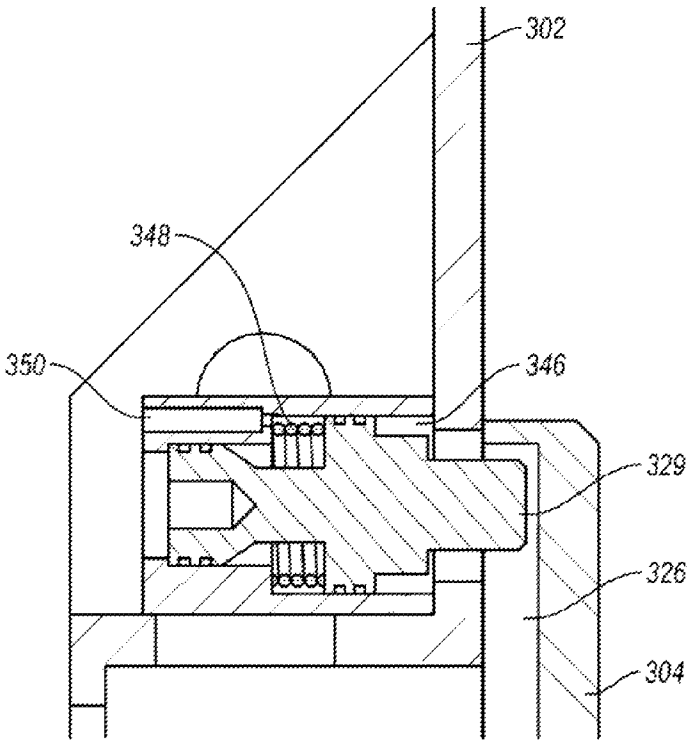
FIG. 18 illustrates a cross-sectional view of an example pin for following a groove of a wellhead latch assembly, in accordance with some embodiments of the present disclosure.

FIGS. 18 and 19 illustrate cross-sectional views of an example locking system in greater detail. More particularly, FIG. 18 illustrates an example embodiment where the locking system for locking the axial and/or rotational position of the outer sleeve 303 relative to the inner core 304 includes a pin 329 which is disposed within the groove 326 of the inner core 304. The groove 326, shown in FIG. 18, may have a generally constant depth and the pin 329 can travel along a length of groove 326. When at the constant depth portion of the groove 326, the pin 329 may be in an outward radial position.

In particular, FIG. 18 illustrates an embodiment in which the pin 329 is located within a chamber 346 of the outer sleeve 346. In general, the pin 329 may be free to move radially inward within the chamber 346, except that in the illustrated embodiment the depth of the groove 326 may restrict radially inward movement. A biasing mechanism e.g., spring 348 and/or piston 350) may be used to bias the pin 329 to a radially inward position nearer the inner core 304. For instance, the spring 348 may be compressed from its equilibrium length. The piston 350 may supply a fluid into the chamber 346. The fluid may begin to fill the chamber 346, or a portion thereof. As the chamber fills, the fluid may press the pin 329 towards the inner core 304. While both the spring 348 and piston 350 are illustrated, other embodiments contemplate use of one of the spring 348 or the piston 350, or either may be removed entirely and replaced with another biasing mechanism.

The depth of groove 326 may also change over its length and in one embodiment can increase at one or more locations. In such embodiment, as pin 329 moves within the groove 326, the pin 329 may ultimately move to a position where the groove 326 has an increased depth or is deeper. As shown in FIG. 19, for instance, the groove 326 may include a portion 327 of increased depth. When the pin 329 is aligned with the portion 327, the biasing force of the spring 348, the piston 350 or some other mechanism may cause the pin 329 to further move radially inward. As discussed herein, once in the deeper portion 327, the pin 329 may lock the outer sleeve 302 relative to the inner core 304 by restricting or potentially preventing further axial and/or rotational movement of the outer sleeve 302 relative to the inner core 304.

The location of the portion 327 having increased depth may be changed or varied as desired. In one embodiment, a single portion 327 may exist over a length of the groove 326. For instance, with reference to FIG. 9, the groove 326 could have an increased depth at a location 16. Thus, when a pin 329 starts at position 1, the pin 329 may travel nearly the full length of the groove 326, and around nearly the full circumference of the inner core 304, before reaching the portion 327 where the pin 329 locks within the groove 326. As will be appreciated by a person having ordinary skill in the art in view of the disclosure herein, the position 16 may correspond to a location where an outer sleeve 302 is compressed towards an inner core 304. In other embodiments, however, the groove 326 may be deeper, or otherwise structured to lock with a pin 329 at a location corresponding to an uncompressed compressible) or expanded state. For instance, a pin 329 may align with a deeper portion 327 of the groove 326 at the position 15 of FIG. 9. Of course, multiple locations may be provided to lock a pin within the groove 326, or the location may be varied as desired. Likewise, the use of a deeper portion 327 of groove 326 to lock the outer sleeve 302 with the inner core 304 is optional.

In use, the increased depth of the groove 326 may enable some embodiments of the present disclosure to signal to an operator when the wellhead latch assembly 300 is latched and locked in place. For instance, a conveyance system 310 may be used to apply a force to latch and ultimately lock a wellhead latch assembly 300 on a wellhead 340. Cycling force loads may compress and decompress the wellhead latch assembly 300, as previously disclosed, and thereby latch and unlatch the wellhead latch assembly 300 to a wellhead 340. However, once the pin 329 drops or becomes disposed into a deeper portion 327 of the groove 326, the wellhead latch assembly 300 may be latched to the wellhead 340 and the outer sleeve 302 may have a locked axial and/or rotational position relative to the inner core 304. In such position, the wellhead latch assembly 300 may resist both compressive and tensile loads on the conveyance system 310. By simply attempting to pull or push on the conveyance system 310, an operator may then be able to determine when the wellhead latch assembly 300 is not simply latched relative to the wellhead 340, but also when the wellhead latch assembly 300 and wellhead 340 are locked relative to each other.

In some embodiments, the pin 329 of FIGS. 18 and 19 may remain within the portion 327 of the groove 326 until it is manually removed (e.g., by manually releasing pressure applied by the piston 350 following removal of the wellhead latch assembly 300). In other embodiments, however, the pin 329 may be released in other manners. By way of example, the piston 350 may be linked to a pressure sensor or itself may act as a pressure sensor. As a result, the force exerted by the piston 350 may increase or decrease depending on the underwater depth of the piston 350. In one example, the piston 350 may use hydraulic fluid pressure to exert a larger force when further underwater, and gradually release the force as the piston 350, and the corresponding wellhead latch assembly 300, move towards the surface. Upon reaching the surface, the pin 329 may be removable from the portion 327 of groove 326. In other embodiments, however, the piston 350 may operate in the opposite manner to increase the force as the depth decreases so that it is more difficult to unlock the outer sleeve 302 from the inner core 304 as the surface approaches. In either embodiment, upon reaching the surface, the piston 350 can be charged or released to allow the pin 329 to retract from the portion 327 of the groove 326.

The particular description provided herein is intended to provide some background for some example embodiments, but is not intended to be limiting of the disclosure herein. Indeed, the various embodiments that are described and illustrated may be varied in any number of different manners. For instance, referring briefly to FIG. 8, the example wellhead latch assembly 300 may include a cap 322, which defines an upper end portion of a chamber into which the biasing member 320 is located, attaches to the conveyance system 310, or performs any number of other functions. The cap 322 may be removable and/or include a component that is separate from the outer sleeve 302. In other embodiments, however, the outer sleeve 302 and cap 372 may be integrally formed.

The inner core 304 may also include a groove 326 as described herein, which groove can be used in connection with a set of one or more pins 328. The particular construction of the groove 326 may change. As described herein, for instance, the groove 326 may allow for cycled loading, with each loading cycle causing a rotation of about forty-five degrees. In other embodiments, more or less rotation may occur in a particular cycle, or there may not be any rotation. Further, the height of the groove 326 may vary. In one embodiment, for instance, the difference in height between the top and bottom of the groove 326 may be between about five inches (127 mm) and about sixty inches (1,524 mm). For instance, the height of the groove 326 may be between about fifteen inches (381 mm) and about thirty inches 762 mm). In one particular embodiment, the height of the groove 326 may be about twenty inches (508 mm), in which case, axial movement of twenty inches (508 mm) of the conveyance system 310 may be sufficient to cycle the outer sleeve 302 relative to the inner core 304. Of course, in other embodiments the height of the groove 326 may be larger than about sixty inches (1,524 mm) or less than about five inches (127 mm). The particular height between one or more tops and bottoms of groove 326 may be set such that a greater force is applied to the conveyance system 310 in order move the pins 328 further along the groove 326. In this way, the relative height between a top and bottom of groove 326 can be set to act as a lock to prevent further movement of the pins 328 along groove 326 and thereby prevent further latching or unlatching of the wellhead latch assembly 300 from the wellhead 340. Further, while the groove is illustrated as being located on the inner core 304, with the pins 328 coupled to the outer sleeve 302, such positions may be reversed in other embodiments.

A wellhead latch assembly consistent with embodiments of the present disclosure may also include still other or additional components or aspects. As illustrated in FIG. 6, for instance, a wellhead latch assembly 300 may include vents for fluid and/or debris. As discussed herein, one embodiment of the present disclosure contemplates use of a wellhead latch assembly 300 in connection with a cutting tool for cutting or severing a casing in a well. Debris may form as the well casing is cut, and the wellhead latch assembly 300 may allow such debris to exit the wellhead latch assembly 300 via vents. In the embodiment in FIG. 6, for instance, a set of vents 352 may be formed in the shoulder 314 and allow debris inside a wellhead 340 to exit into the interior of the outer sleeve 302. The outer sleeve 302 may also include various vents 354, 356 to allow the debris to exit the top and/or side of the wellhead latch assembly 300. In this particular embodiment, the vents 354 may include longitudinal openings within the circumferential surface of the skirt 318, and the vents 356 may include openings at the top surface of the skirt 318. There may be eight of each type of vent 354, 356 and/or four vents 352 as generally shown in FIG. 6; however, the number, position, and configuration of the vents may vary.

Further still, aspects of the present disclosure may relate to a wellhead latch assembly 300 that may be used without hydraulic latching devices and/or without rotational monitoring systems. For instance, the latches 330 may be mechanically actuated by pushing and/or pulling the conveyance system 310. No hydraulic line may be used to engage the latches 330 and/or there may not be any rotational controls to measure the rotation of the outer sleeve 302 and/or inner core 304. In other embodiments, however, hydraulic lines or sensors may be used. Further still, while a hydraulic piston may be used in some embodiments to lock a travel pin 328 within a groove 326, other embodiments contemplate hydraulic-less designs, or pre-charged chambers such that supply of hydraulic fluid through the conveyance system or other sources may not be used during operation.

While wellhead latch assemblies are described herein with primary reference to well abandonment and wellhead recovery processes, such embodiments are provided solely to illustrate one environment in which aspects of the present disclosure may be used. In other embodiments, latches, locks, or other components discussed herein, or which would be appreciated by a person having ordinary skill in the art in view of the disclosure herein, may be used in other applications, environments or industries. For instance, similar assemblies, systems, and methods may be used in connection with exploration or drilling for water, placement of utility lines, and the like.

Thus, although the foregoing description contains many specifics, these should not be construed as limiting the scope of the disclosure or of any of the appended claims, but merely as providing information pertinent to some specific embodiments that may fall within the scope of the disclosure and the appended claims. Any features from different embodiments may be employed in combination. In addition, other embodiments of the present disclosure may also be devised which lie within the scopes of the disclosure and the appended claims, including any equivalent structures or structural equivalents. Additions, deletions and modifications to example embodiments, as disclosed herein, that fall within the meaning and scopes of the claims, are to be embraced by the claims.

What is claimed is:

1. A wellhead latch assembly, comprising:
an inner core;
an outer sleeve enclosing at least a portion of the inner core; and
one or more latches coupled to the inner core, the one or more latches being selectively moveable between at least two positions that include:
a released position when the one or more latches align with one or more cut-outs of the outer sleeve; and
a latched position when the one or more latches are out of alignment with the one or more cut-outs of the outer sleeve, and in which the one or more latches are engageable against an exterior surface of a wellhead.

2. The wellhead latch assembly recited in claim 1, the outer sleeve being movably coupled to the inner core such that the outer sleeve may move in axial and rotational directions relative to the inner core.

3. The wellhead latch assembly recited in claim 2, the one or more latches being moveable between the released and latched positions using one or both of axial or rotational movement of the outer sleeve relative to the inner core.

4. The wellhead latch assembly recited in claim 2, the inner core defining a groove having axial and circumferential features, and the outer sleeve including one or more pins configured to follow the groove.

5. The wellhead latch assembly recited in claim 2, the outer sleeve and inner core being movably coupled such that axial movement of the outer sleeve is configured to cause rotational movement of the outer sleeve relative to the inner core.

6. The wellhead latch assembly recited in claim 1, the inner core including:
a shoulder for engaging a top surface of the wellhead.

7. The wellhead latch assembly recited in claim 1, further comprising:
a biasing member resisting movement of the outer sleeve in at least one axial direction relative to the inner core.

8. The wellhead latch assembly recited in claim 1, the one or more latches include a plurality of dogs engageable with a wellhead by moving in an at least partially radial direction to transition from the released position to the latched position.

9. The wellhead latch assembly recited in claim 1, further comprising:
a locking system for locking at least axial movement of the outer sleeve relative to the inner core.

10. The wellhead latch assembly recited in claim 9, the locking system including a pin of the outer sleeve configured to follow a groove of the inner core, the pin being radially moveable to restrict axial movement of the outer sleeve relative to the inner core.

11. The wellhead latch assembly recited in claim 10, the pin being coupled to an actuator for biasing the pin in a radial position which restricts axial movement of the outer sleeve relative to the inner core.

12. A well abandonment tool, comprising:
a rotary tool; and
a wellhead latch assembly coupled to the rotary tool, the wellhead latch assembly including:
a slotted inner body;
an outer sleeve having one or more pins for following a groove of the slotted inner body; and
one or more latches for selectively engaging a wellhead by translating radially between:
at least one latched position in which the one or more latches are out of alignment with one or more cut-outs of the outer sleeve; and
at least one released position in which the one or more latches are circumferentially and axially in alignment with the one or more cut-outs of the outer sleeve.

13. The well abandonment tool recited in claim 12, the rotary tool including a cutting tool for cutting a borehole casing below a sea floor of a subsea well.

14. The well abandonment tool recited in claim 12, the outer sleeve including a plurality of circumferentially offset cut-outs at a distal end portion of the outer sleeve for alignment with the one or more latches in the at least one released position.

15. The well abandonment tool recited in claim 12, the one or more latches being selectively moveable from a first released position to a first latched position during a single loading cycle, and moveable from the first released position to a second released position after two or more loading cycles.

16. The well abandonment tool recited in claim 12, the one or more latches being configured for selectively engaging an exterior surface of the wellhead when the one or more latches are in the at least one latched position.

17. A method for removing a wellhead, comprising:

deploying a well abandonment tool to a subsea wellhead, the well abandonment tool including a cutting tool and a wellhead latch assembly;

engaging the wellhead latch assembly with the subsea wellhead, the subsea wellhead being coupled to borehole casing;

applying a first axially directed force to the wellhead latch assembly using a conveyance system, the first axially directed force causing the wellhead latch assembly to latch against an exterior surface of the subsea wellhead;

separating the subsea wellhead from at least a portion of the borehole casing using the cutting tool; and removing the subsea wellhead using a second axially directed force on the conveyance system, the second axially directed force being in a direction opposite the first axially directed force.

18. The method recited in claim 17, further comprising:

releasing the first axially directed force, the wellhead latch assembly remaining latched to the subsea wellhead following release of the first axially directed force.

19. The method recited in claim 17, the wellhead latch assembly including an outer sleeve movably coupled to an inner core, and a plurality of latches coupled to the inner core, wherein applying the first axially directed force causes the outer sleeve to travel along a groove defining a rotational and translational movement relative to the inner core.

20. The method recited in claim 19, wherein one or both of translation or rotation of the outer sleeve causes the plurality of latches to move in an at least partially inward, radial direction and to latch to the subsea wellhead.

* * * * *